US008438688B2

(12) United States Patent
Weinberger et al.

(10) Patent No.: US 8,438,688 B2
(45) Date of Patent: May 14, 2013

(54) ICE SCRAPER

(75) Inventors: Marvin Weinberger, Havertown, PA (US); Tucker J. Marion, Holliston, MA (US)

(73) Assignee: MIW Associates, LLC, Havertown, PA (US)

( * ) Notice: Subject to any disclaimer, the term of this patent is extended or adjusted under 35 U.S.C. 154(b) by 590 days.

(21) Appl. No.: 12/692,436

(22) Filed: Jan. 22, 2010

(65) Prior Publication Data

US 2010/0186183 A1 Jul. 29, 2010

Related U.S. Application Data

(60) Provisional application No. 61/146,786, filed on Jan. 23, 2009.

(51) Int. Cl.
*A47L 13/03* (2006.01)

(52) U.S. Cl.
USPC .... 15/111; 15/236.05; 15/236.06; 15/236.09; 15/236.02; 401/25; 30/172; 30/123.3

(58) Field of Classification Search ..... 15/236.01, 15/236.02, 236.05–236.09, 245.1, 233.8; 30/169, 30/172, 286, 287, 123.3; 401/9, 16, 25; 37/278, 37/284, 285
See application file for complete search history.

(56) References Cited

U.S. PATENT DOCUMENTS 401,442 A 4/1889 Lefebure
1,377,484 A * 5/1921 Huneryager ..... 30/172
1,641,522 A * 9/1927 Beckord ..... 30/172
2,036,449 A * 4/1936 Weatherhead ..... 401/263
2,299,089 A 10/1942 Haan
2,532,429 A 12/1950 Sparkman
3,133,301 A 5/1964 Helminen
3,274,684 A 9/1966 Marks
D207,256 S 3/1967 Rippl
3,848,289 A 11/1974 Bachmann
3,981,106 A 9/1976 Gallo
4,091,579 A 5/1978 Giangiulio
4,146,943 A * 4/1979 Wertheimer et al. ..... 15/111
4,164,801 A * 8/1979 Thomas ..... 15/236.02
4,255,880 A 3/1981 McMickle et al.
4,275,476 A 6/1981 Hopkins et al.
4,281,433 A 8/1981 Sendoykas
4,364,145 A 12/1982 Jones et al.
4,418,439 A 12/1983 Porchet
4,422,206 A 12/1983 Brace et al.
4,712,269 A 12/1987 Worthen
D309,206 S 7/1990 Kelley
5,101,529 A 4/1992 Tippie (Continued)

OTHER PUBLICATIONS

Co-pending application U.S. Appl. No. 12/408,403, filed Mar. 20, 2009.

(Continued)

*Primary Examiner* — Mark Spisich
*Assistant Examiner* — Andrew A Horton
(74) *Attorney, Agent, or Firm* — Duane Morris LLP

(57) ABSTRACT

A hand held scraper tool adapted to remove debris from a surface. The scrapper tool includes a body, handle and a plurality of abraders. In one embodiment, the abraders may be configured as a highly flexible cantilevered structure. In another embodiment, the abraders may be configured as a brush that creates a water impermeable barrier.

20 Claims, 31 Drawing Sheets

U.S. PATENT DOCUMENTS

| | | | | |
|---|---|---|---|---|
| 5,179,754 | A | 1/1993 | Stradnick | |
| 5,435,064 | A | 7/1995 | Brookfield | |
| D365,180 | S | 12/1995 | Brookfield | |
| 5,471,698 | A | 12/1995 | Francis et al. | |
| 5,680,668 | A | 10/1997 | Kim | |
| 5,758,983 | A | 6/1998 | Thomas | |
| 5,781,957 | A | 7/1998 | Scholl | |
| 5,806,134 | A | 9/1998 | Merrell | |
| 5,839,151 | A | 11/1998 | Whaley | |
| 5,908,255 | A | 6/1999 | Branch | |
| 5,915,794 | A | 6/1999 | Neff | |
| 5,983,504 | A | 11/1999 | Tisbo et al. | |
| 6,018,836 | A | 2/2000 | Williams | |
| 6,216,306 | B1 | 4/2001 | Esterson et al. | |
| 6,243,906 | B1 | 6/2001 | Holliday et al. | |
| 6,282,742 | B1 * | 9/2001 | Boggs | 15/236.02 |
| D460,589 | S | 7/2002 | Weinberger et al. | |
| 6,629,331 | B2 | 10/2003 | Panfili | |
| D499,852 | S | 12/2004 | Trunecek | |
| 7,249,393 | B2 | 7/2007 | Marion et al. | |
| 7,370,384 | B2 | 5/2008 | Miller et al. | |
| 7,526,831 | B2 | 5/2009 | Weinberger et al. | |
| 2003/0146632 | A1 | 8/2003 | Marion et al. | |
| 2005/0172442 | A1 | 8/2005 | Trunecek | |
| 2005/0210616 | A1 | 9/2005 | Santefort | |

OTHER PUBLICATIONS

International Search Report dated Jul. 30, 2010 from corresponding PCT/US2010/021846 filed Jan. 22, 2010.

Weinberger et al.—U.S. Appl. No. 61/266,769, filed Dec. 4, 2009.

* cited by examiner

FIGURE 12
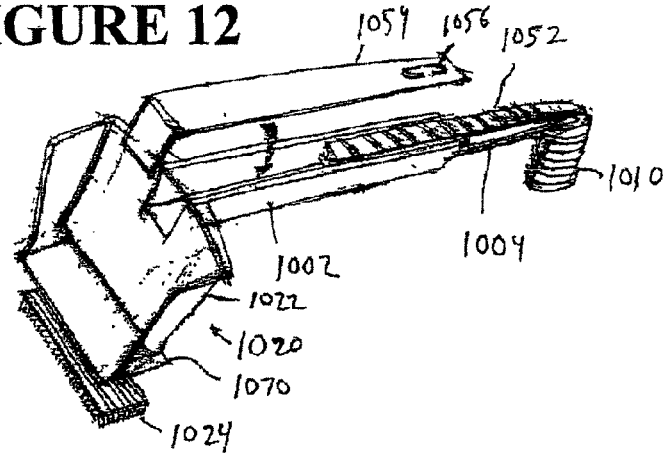
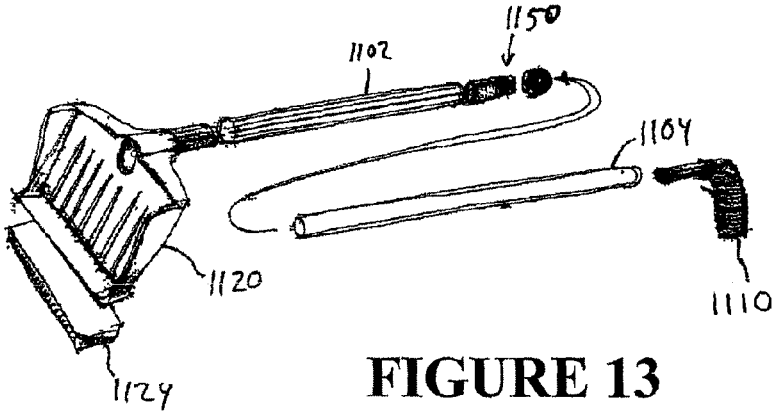
FIGURE 13

FIGURE 14
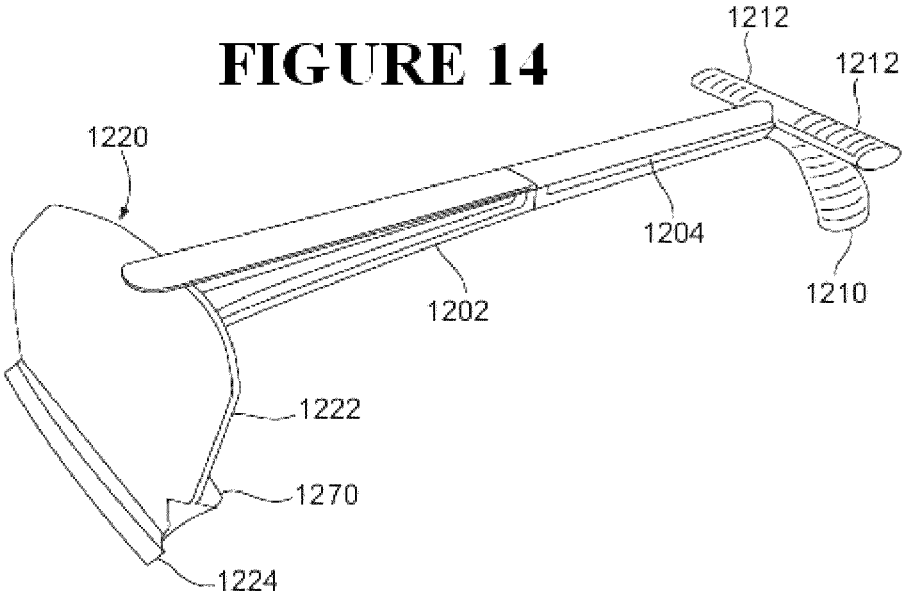
FIGURE 15(a)
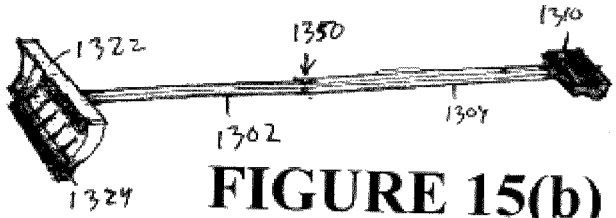
FIGURE 15(b)
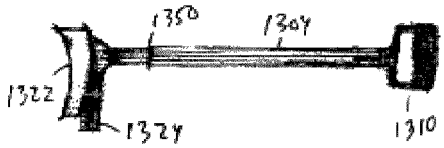
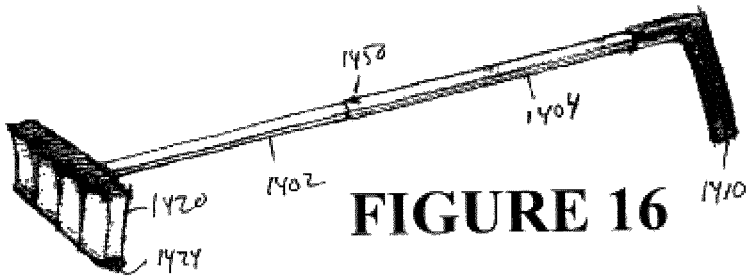
FIGURE 16

FIGURES 23(a)
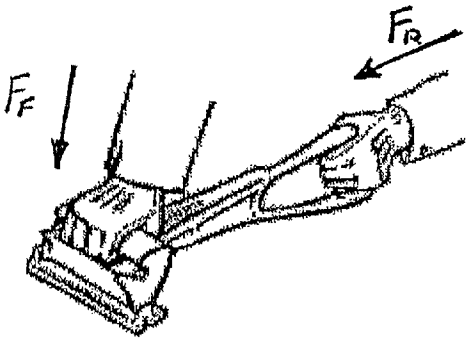
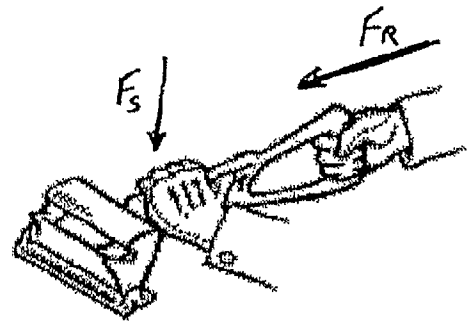
FIGURES 23(b)
FIGURES 24(a)
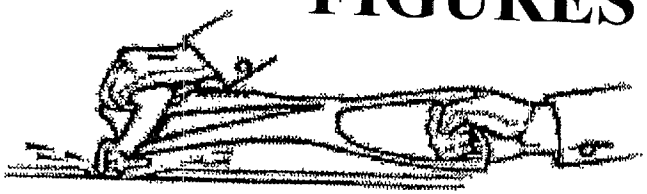
FIGURES 24(b)
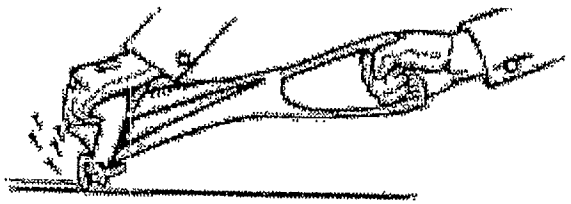
FIGURES 24(c)
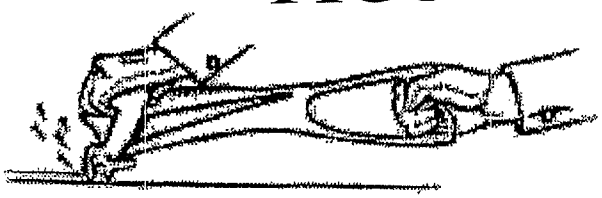

ICE SCRAPER

This application is a non-provisional of and claims benefit of priority to U.S. Provisional Patent Application No. 61/146,786, filed Jan. 23, 2009, herein incorporated by reference in its entirety.

BACKGROUND OF THE INVENTION

1. Field of the Invention

The present invention relates to the field of hand held scraping tools for removing debris from a surface. In an exemplary embodiment, the invention can be particularly effective for removing frost, snow, and/or ice from a curved or multi-planar surface.

2. Description of the Related Technology

Conventional ice scrapers generally have inadequate abrasive surfaces and flexibility to enable efficient removal of ice, snow and frost, particularly from curved surfaces such as the windshield of automobiles. Typically, these ice scrapers have an elongated handle attached to a blade including a continuous blade edge for scraping a surface. Upon applying force to the handle, the blade is pushed across a surface while the blade edge burrows into and deflects ice away from the blade edge. The blade edge is generally the sole abrasive feature of the ice scraper and only enables scraping in one direction.

Additionally, conventional ice scrapers are inflexible. Their body and blade are designed to be rigid in order to apply a concentrated force to a surface in order to dislodge and deflect ice annealed thereon. This rigidity, however, also prevents the blade and blade edge from conforming to curved or multi-planar surfaces. Consequently, traditional ice scrapers are unable to effectively remove ice, snow or frost from curved or multi-planar surfaces, such as the headlight and surrounding frame of a vehicle.

Furthermore, the elongated narrow handle of conventional ice scrapers requires a user expend an excessive amount of force to scrape away ice that has adhered to a surface. The handles are neither ergonomic nor do they effectively transfer the applied force to a surface to be cleaned.

In view of the aforementioned limitations of the prior art, there exists a need to develop an improved ice scraper with a flexible blade capable of more effectively removing a substance from a surface.

SUMMARY OF THE INVENTION

The invention is directed to a hand held scraper for removing substance from a surface. In one embodiment, the hand held scraper includes a body, a handle attached to the body and a first set of flexible cantilevered abraders capable of independently moving relative to one another. At least one cantilevered abraders of the first set includes a first end hinged to a surface of the body; a first groove defined in an upper surface of the cantilever abrader, wherein the first groove extends along a width of said cantilever abrader and is positioned adjacent to the first end; and a scraping edge. The scraper further includes two substantially rigid members that constrain a vertical range of motion of the cantilever abraders, wherein the first set of cantilever abraders are positioned adjacent to and between the two substantially rigid members.

In another aspect of the invention, the hand held scraper includes a body, a handle attached to the body and a plurality of flexible cantilevered abraders capable of independently moving relative to one another. At least one cantilevered abrader of said plurality of cantilevered abraders includes a first end hinged to a surface of the body; a first groove defined in an upper surface of the cantilevered abrader; a second groove defined in a lower surface of the cantilevered abrader, wherein the first and second grooves extend along a width of the cantilever abrader and are positioned adjacent to the first end and a scraping edge. The thickness of the cantilever abrader between the first and second groove is about 0.5 cm to about 1.5 cm to enable flexible vertically displacement of the cantilever abrader.

BRIEF DESCRIPTION OF THE DRAWINGS

FIG. 1(*b*) is another perspective side elevational view of the exemplary scraper tool of FIG. 1(*a*).

FIG. 1(*c*) is a rear perspective view of the of the exemplary scraper tool of FIG. 1(*a*) a portion of the shield removed.

FIG. 1(*d*) is a cross section of the exemplary scraper tool of FIG. 1(*a*) showing the connecting member and mating element of the structural member.

FIG. 1(*e*) is a bottom perspective view of the exemplary scraper tool of FIG. 1(*a*) showing cantilever abrader and scraper projections.

FIG. 1(*f*) is another side perspective view of the exemplary scraper tool of FIG. 1(*a*).

FIG. 1(*g*) is a close-up perspective view of the cantilever abraders and constraint members of FIG. 1(*a*).

FIG. 1(*h*) is a cross-section of the exemplary scraper tool of FIG. 1(*a*) showing the removable frame member and scraping projections.

FIG. 1(*i*) is a cross-section of the exemplary scraper tool of FIG. 1(*a*) showing a liquid dispensing mechanism.

FIG. 2(*b*) is a side view of the scraper tool of FIG. 2(*a*).

FIG. 2(*c*) is a first cross-sectional view of the scraper tool of FIG. 2(*a*).

FIG. 2(*d*) is a second cross-sectional view of the scraper tool of FIG. 2(*a*).

FIG. 12 is a perspective illustration of another embodiment of a scraper tool according to the present invention;

FIG. 13 is a perspective illustration of a different embodiment of the scraper tool according to the present invention;

FIG. 14 is a perspective illustration of yet another embodiment of the scraper tool according to the present invention;

FIG. 15(*a*) is a perspective illustration and FIG. 15(*b*) is a side view of an exemplary embodiment of a scraper tool according to the present invention; and FIG. 16 is a perspective illustration of an embodiment of a scraper tool according to the present invention.

FIGS. 23(*a*)-23(*b*) show several ways of gripping the scraper tool of FIG. 19;

FIGS. 24(*a*)-24(*c*) show several ways of using the scraper tool of FIG. 19;

DETAILED DESCRIPTION OF THE PREFERRED EMBODIMENT(S)

Figure 1A:
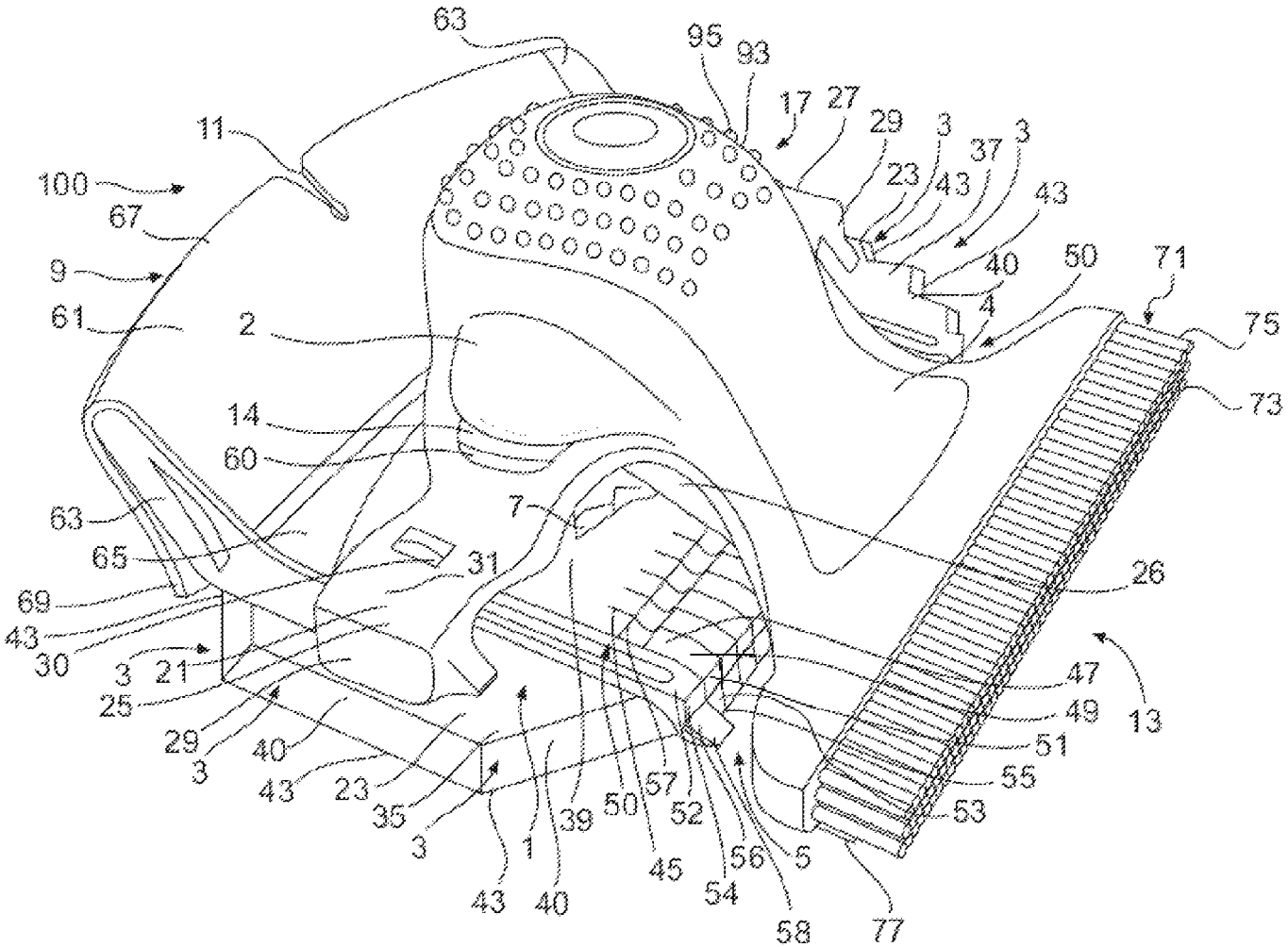
FIG. 1(*a*) is a perspective side elevational view of an exemplary scraper tool.
Figure 1B:
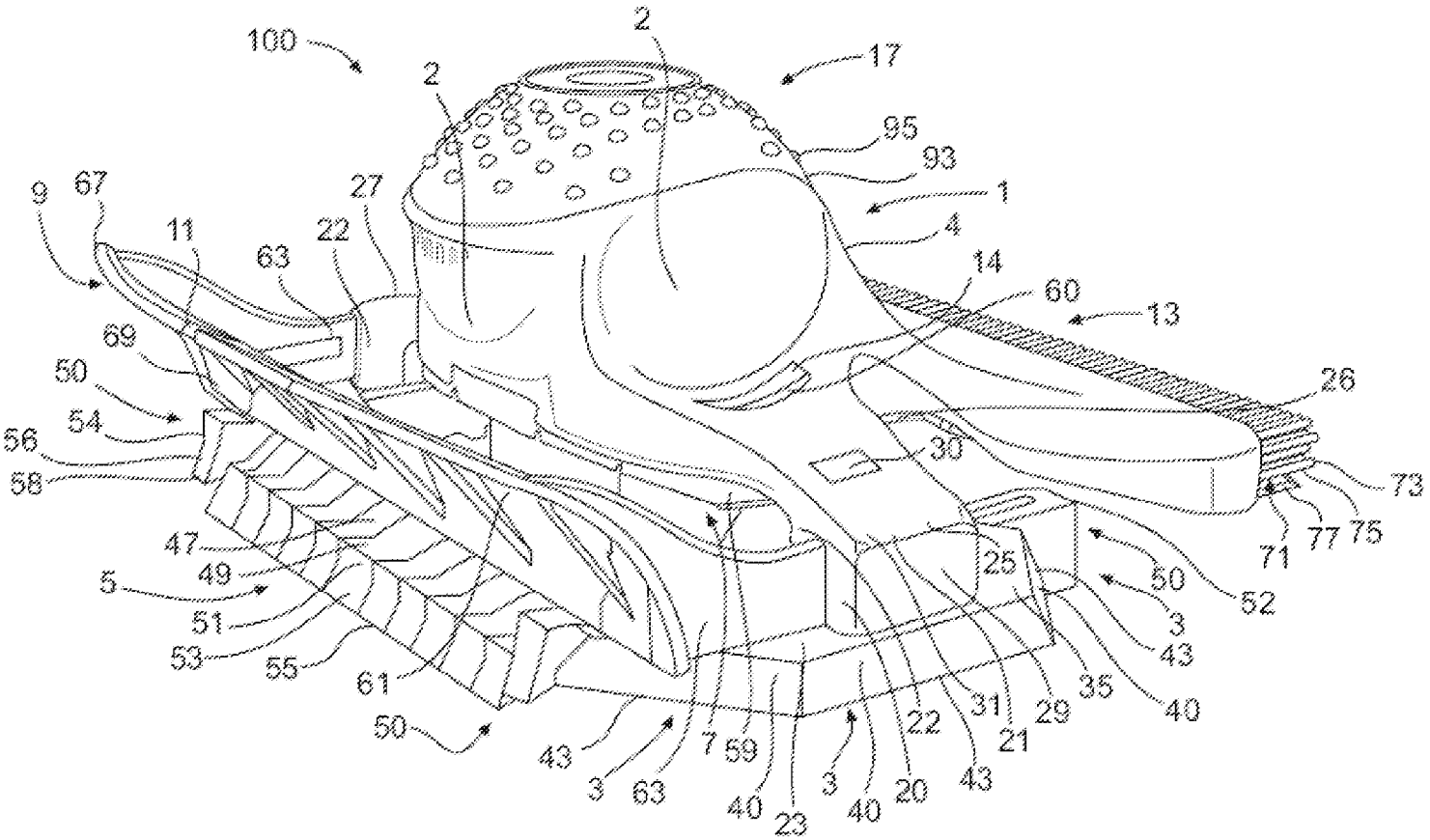
Figure 1C:
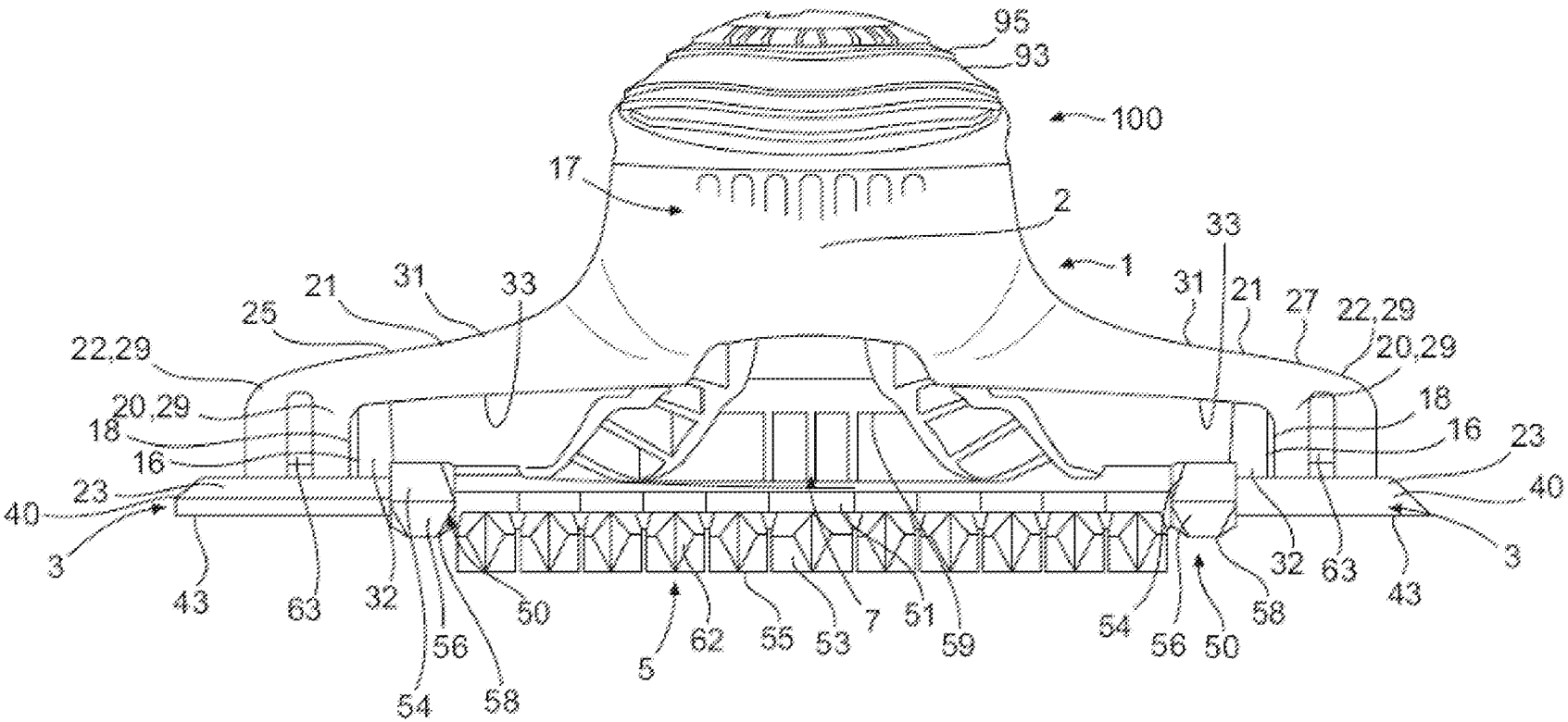
Figure 1D:
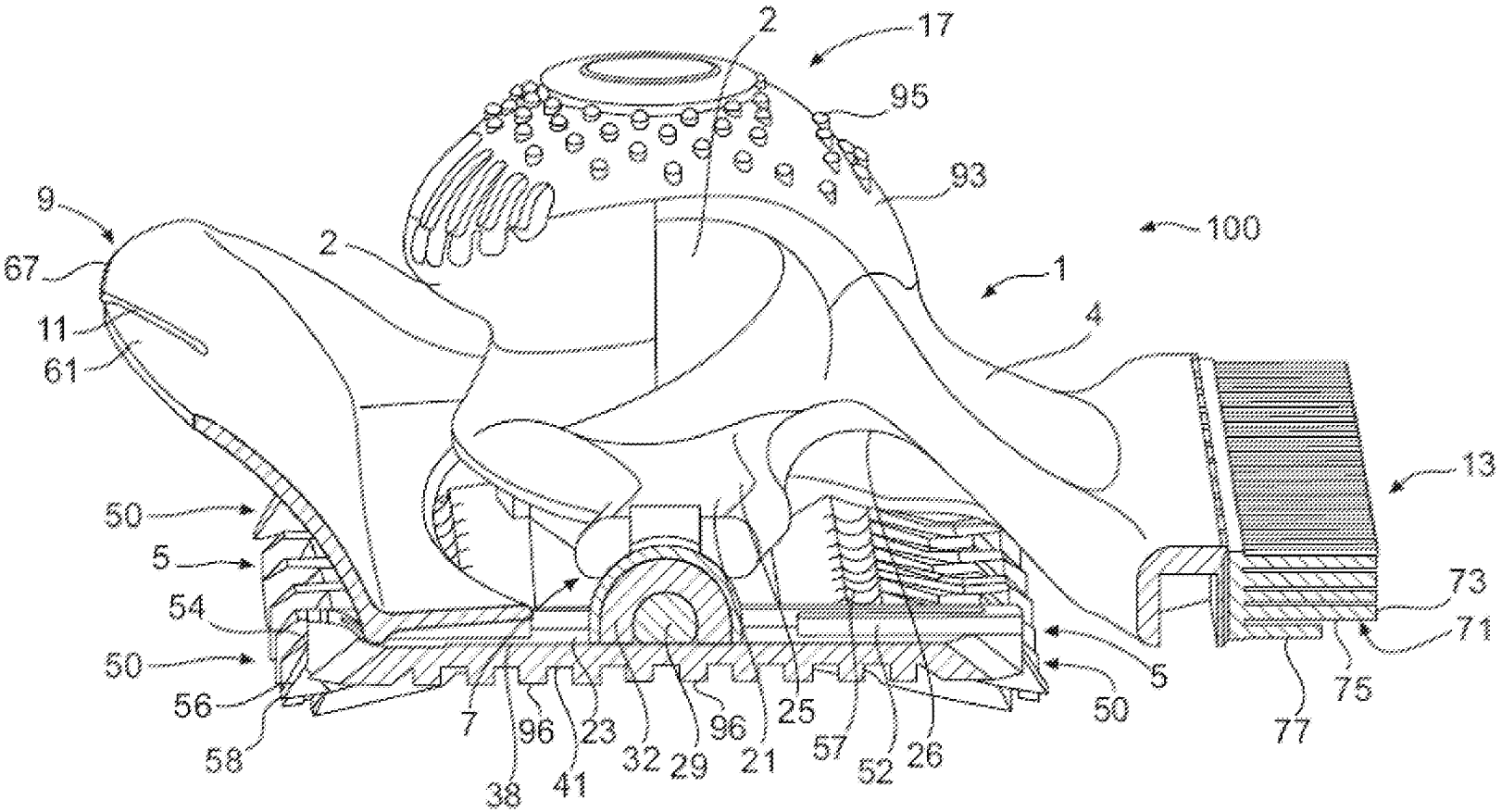
Figure 1E:
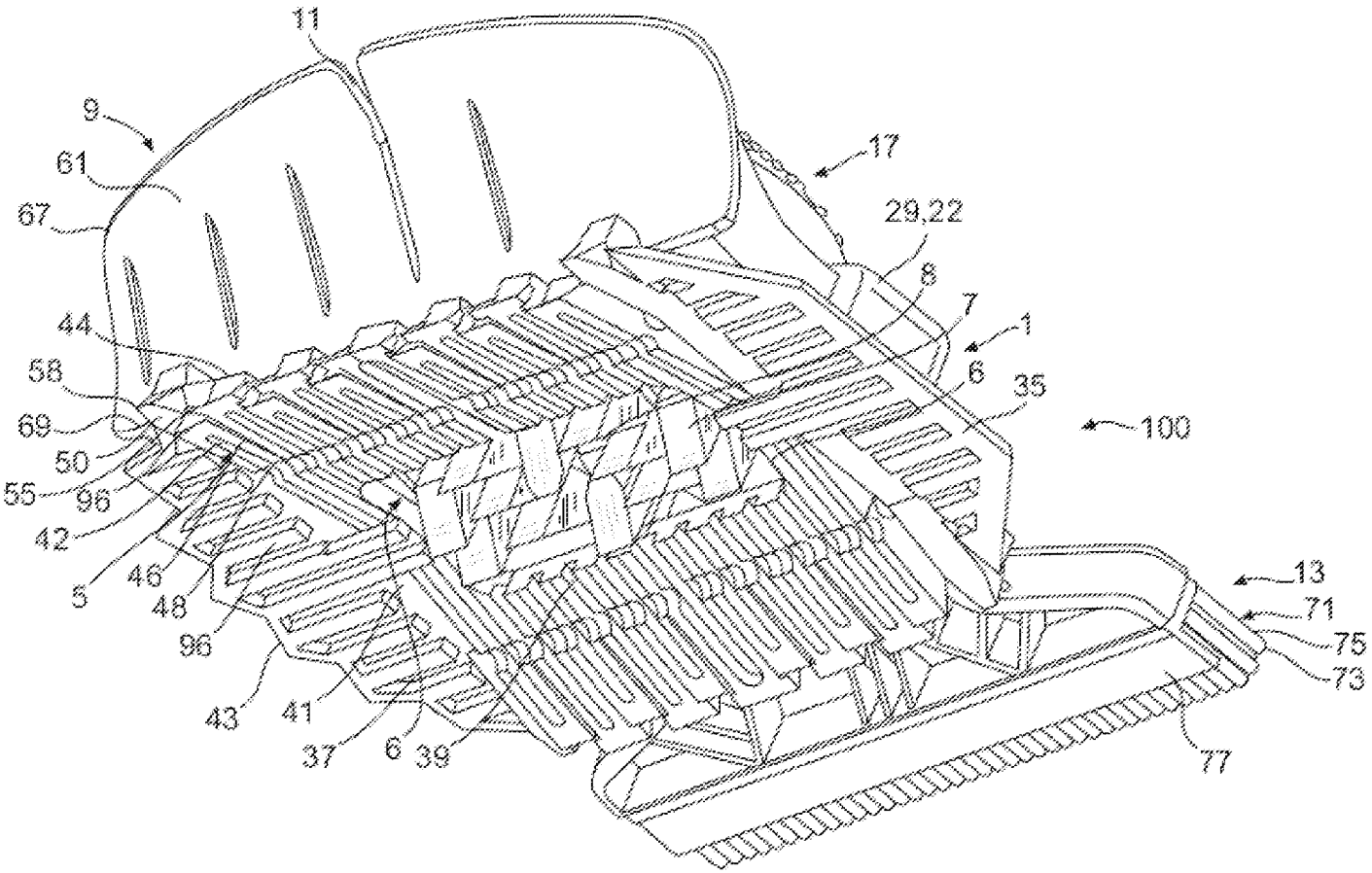
Figure 1F:
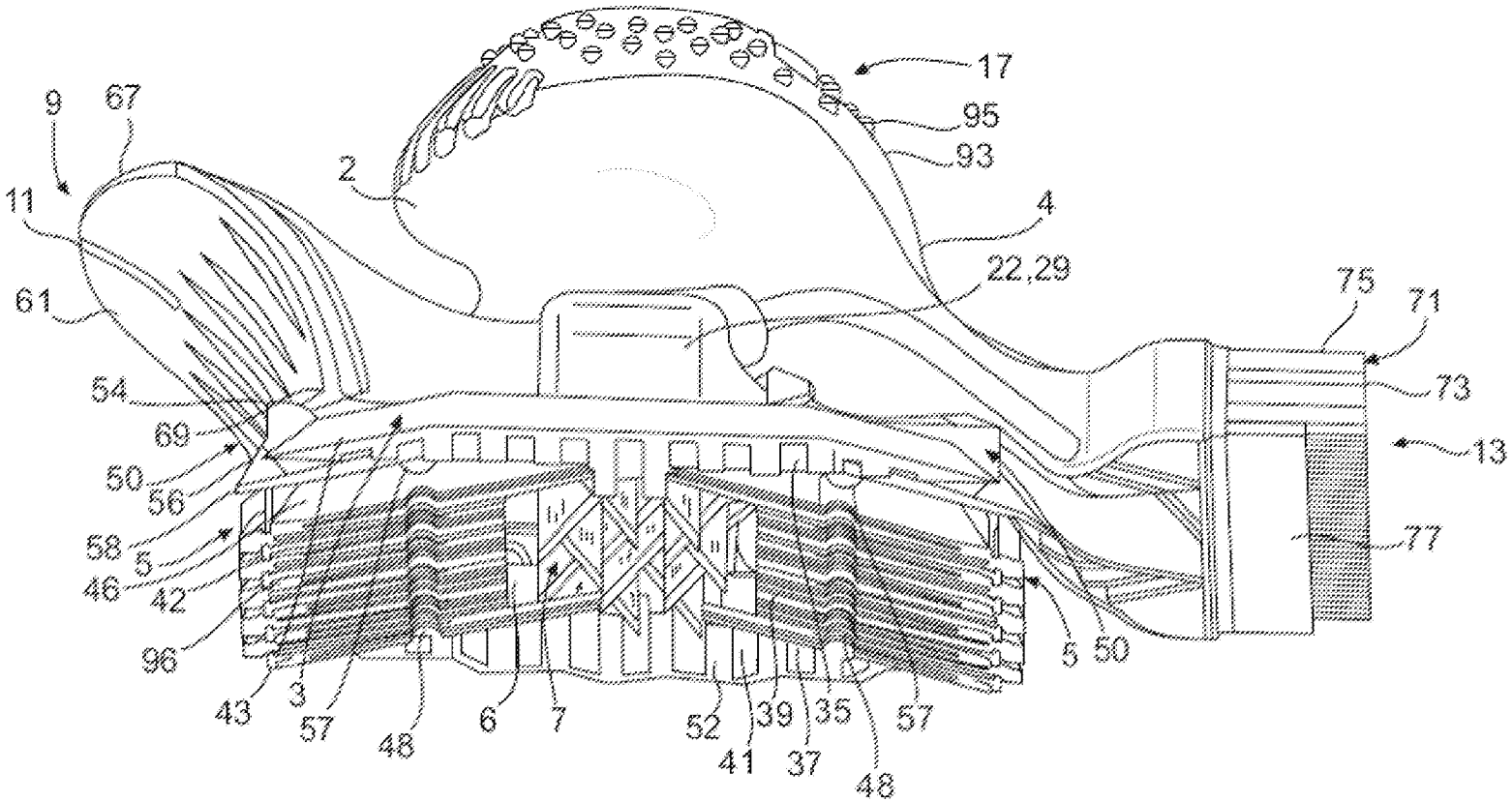
Figure 1G:
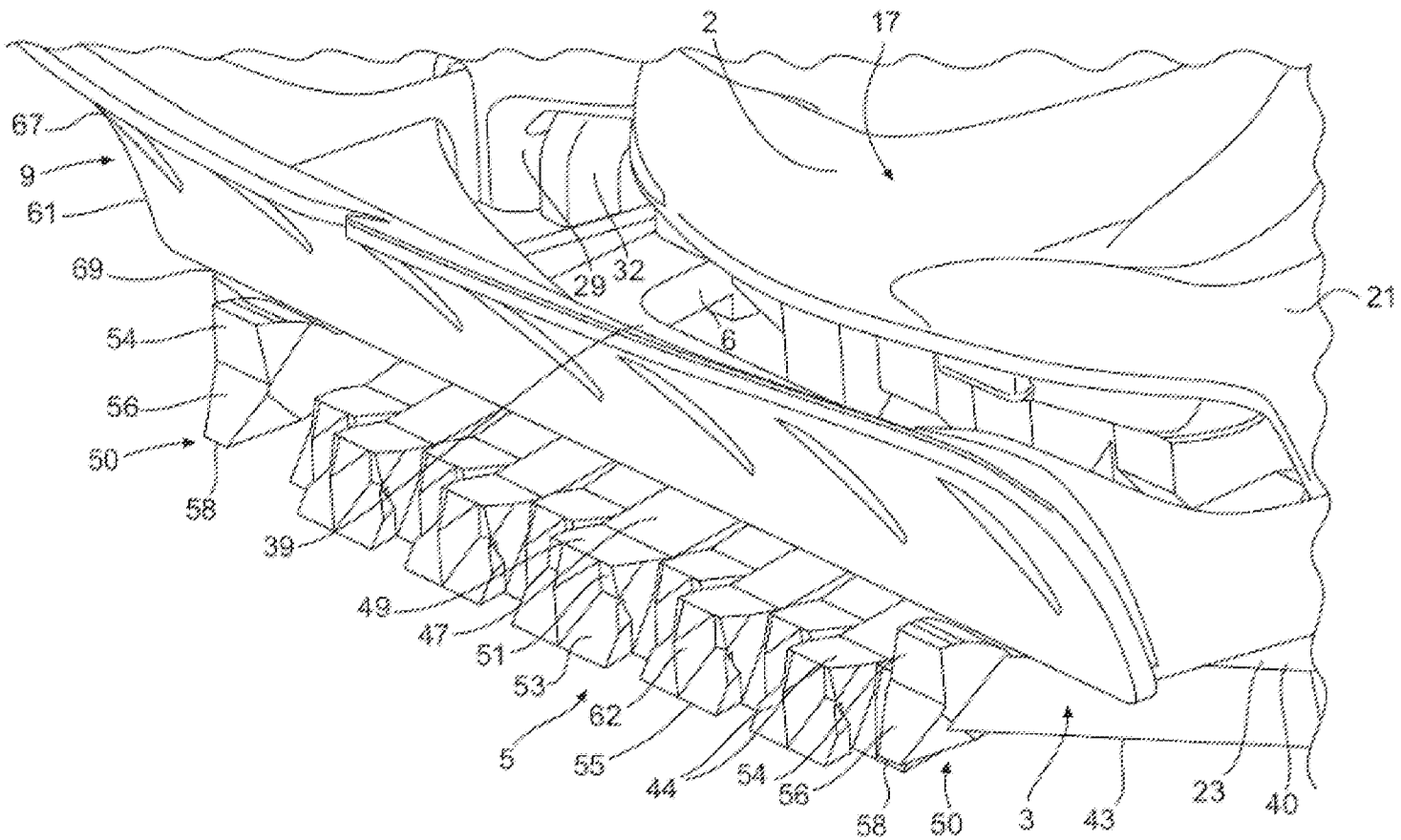
Figure 1H:
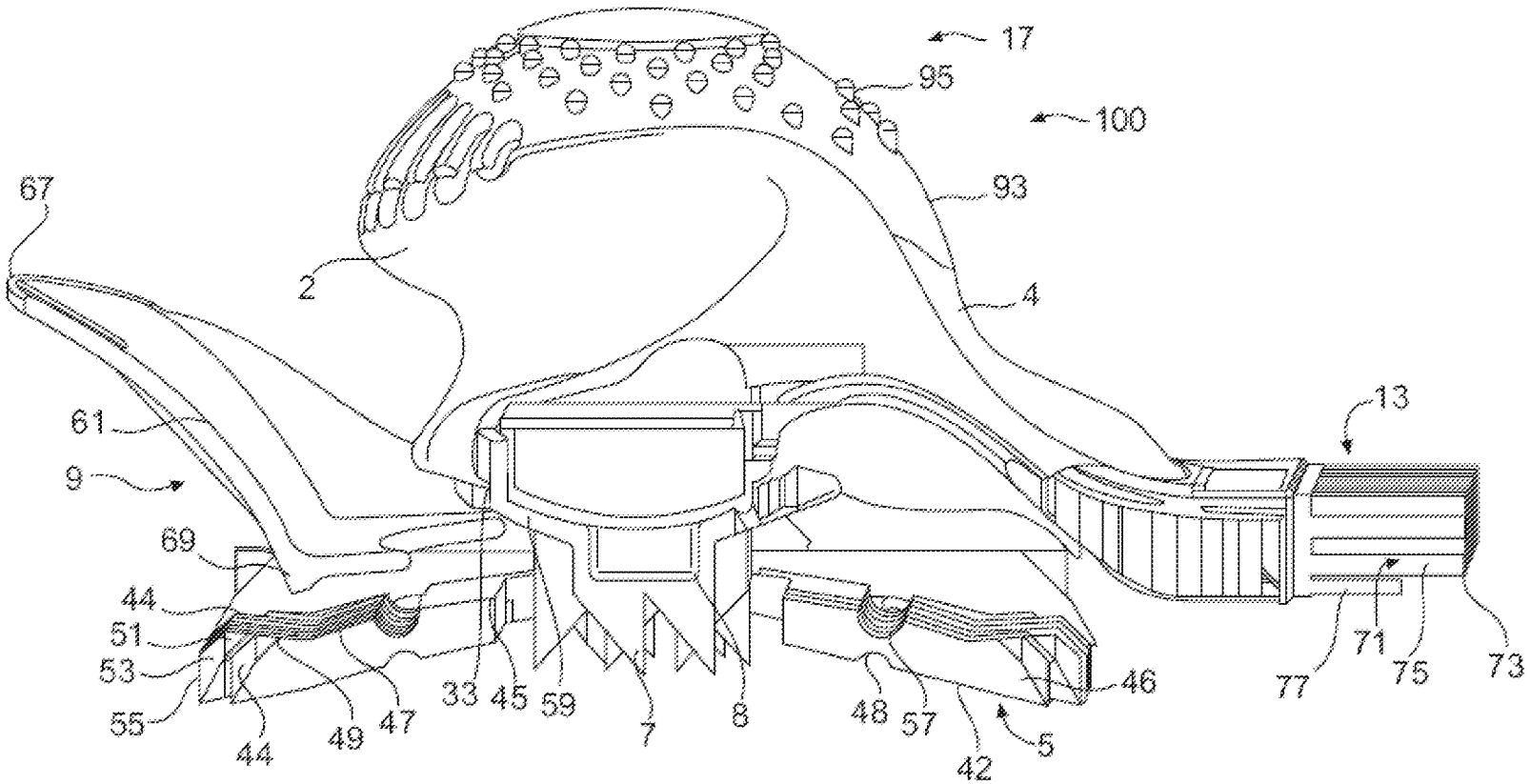
Figure 1I:
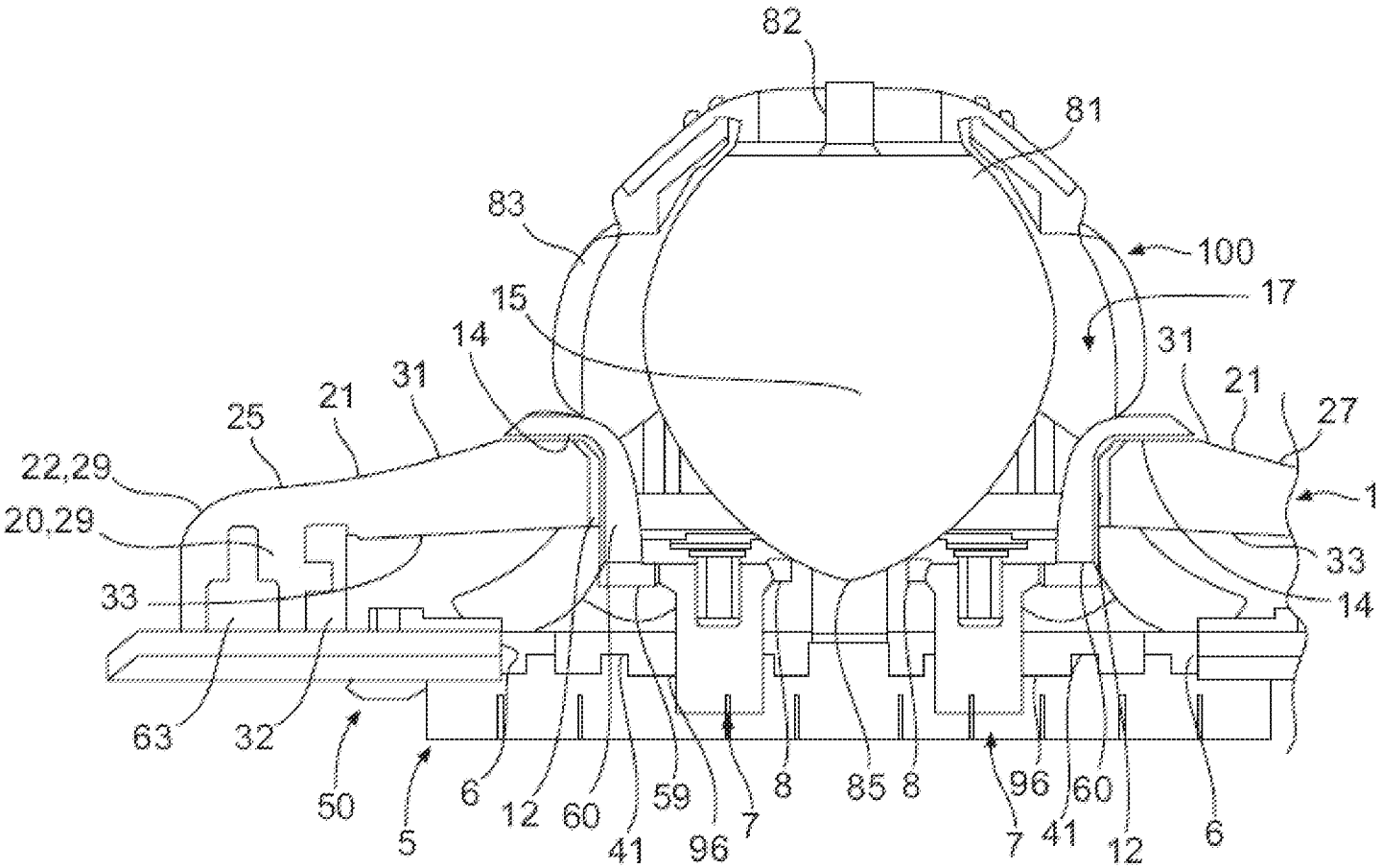
Figure 2A:
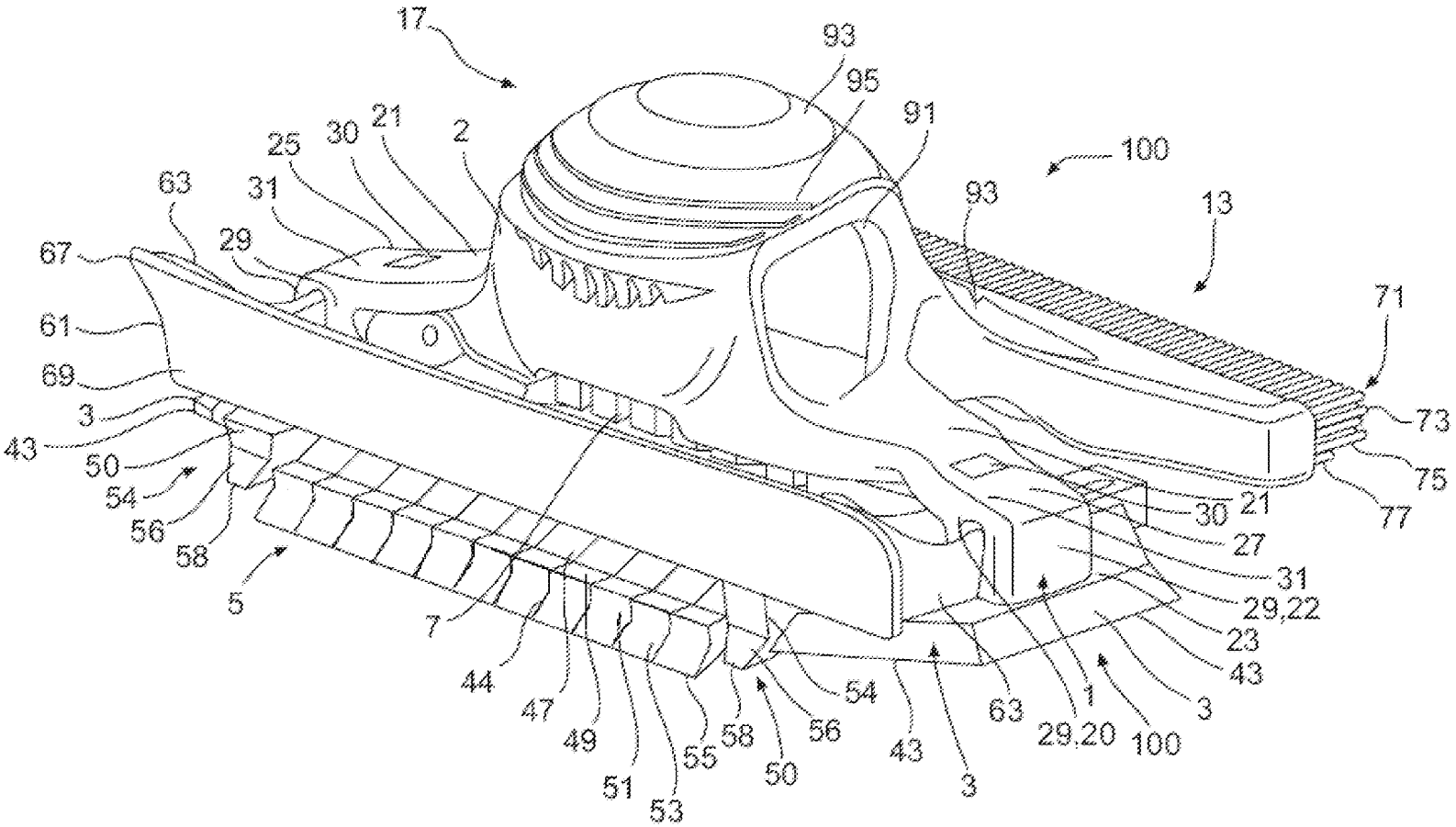
FIG. 2(*a*) is a perspective side view of another exemplary scraper tool.
Figure 2B:
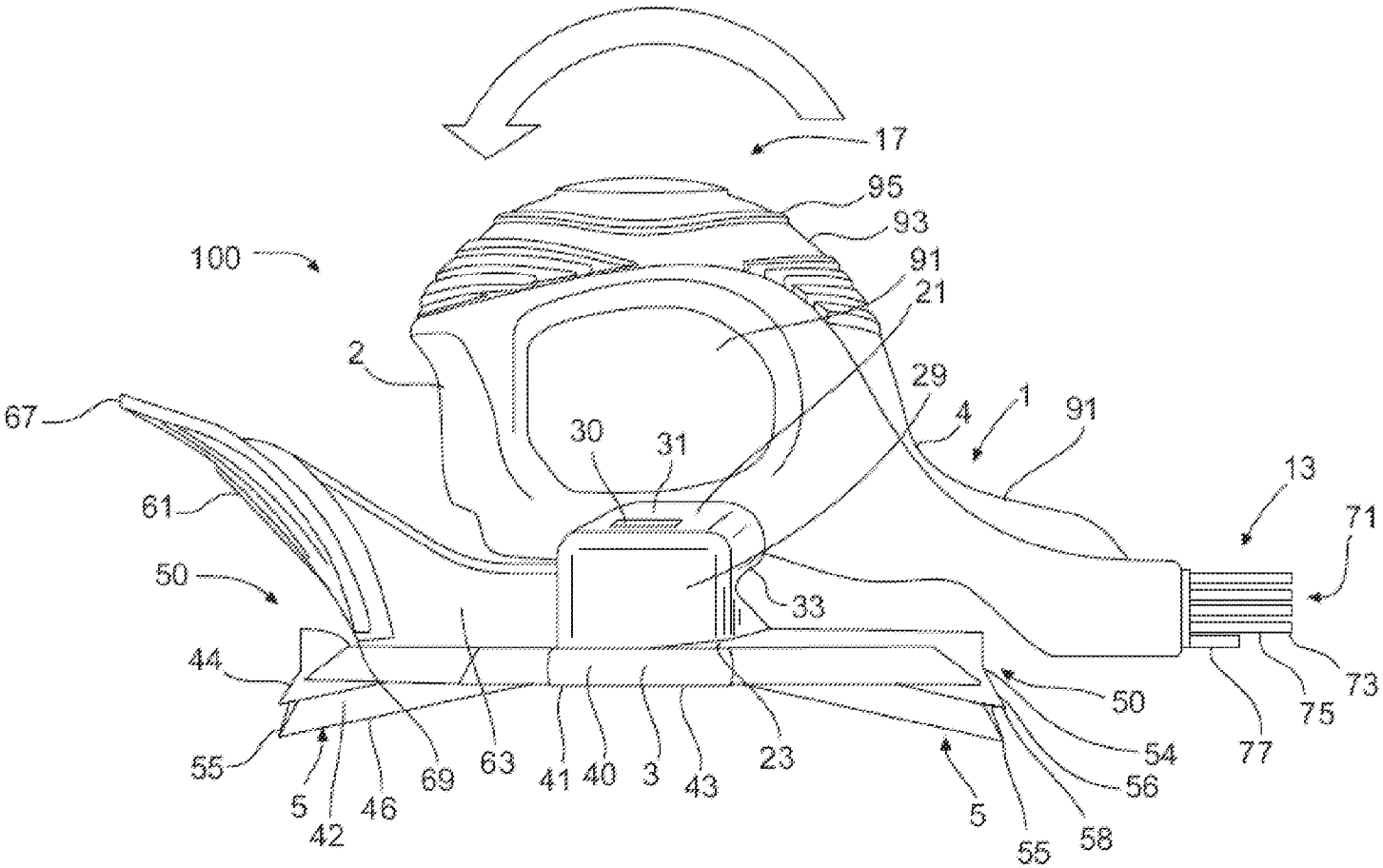
Figure 2C:
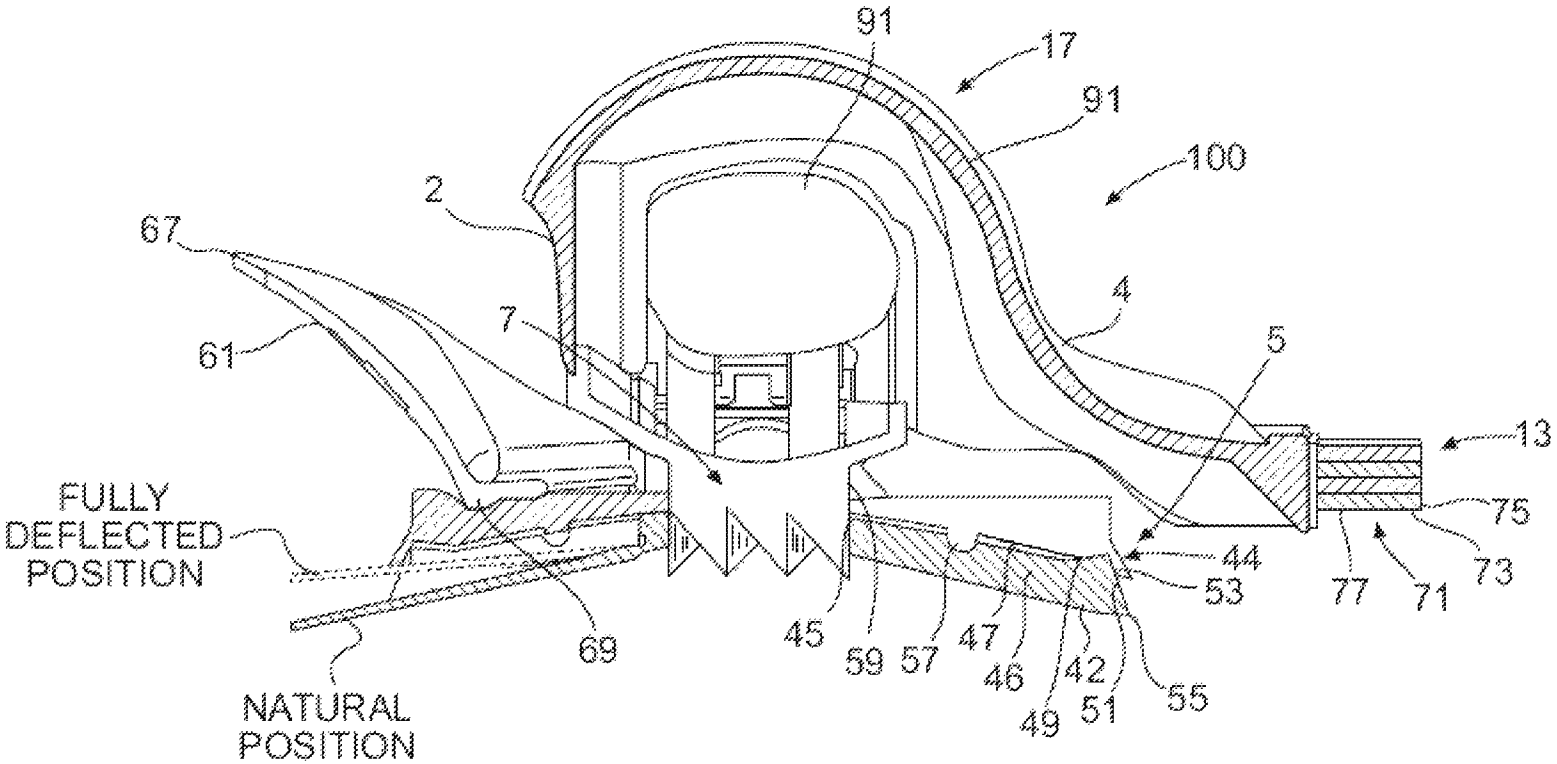
Figure 2D:
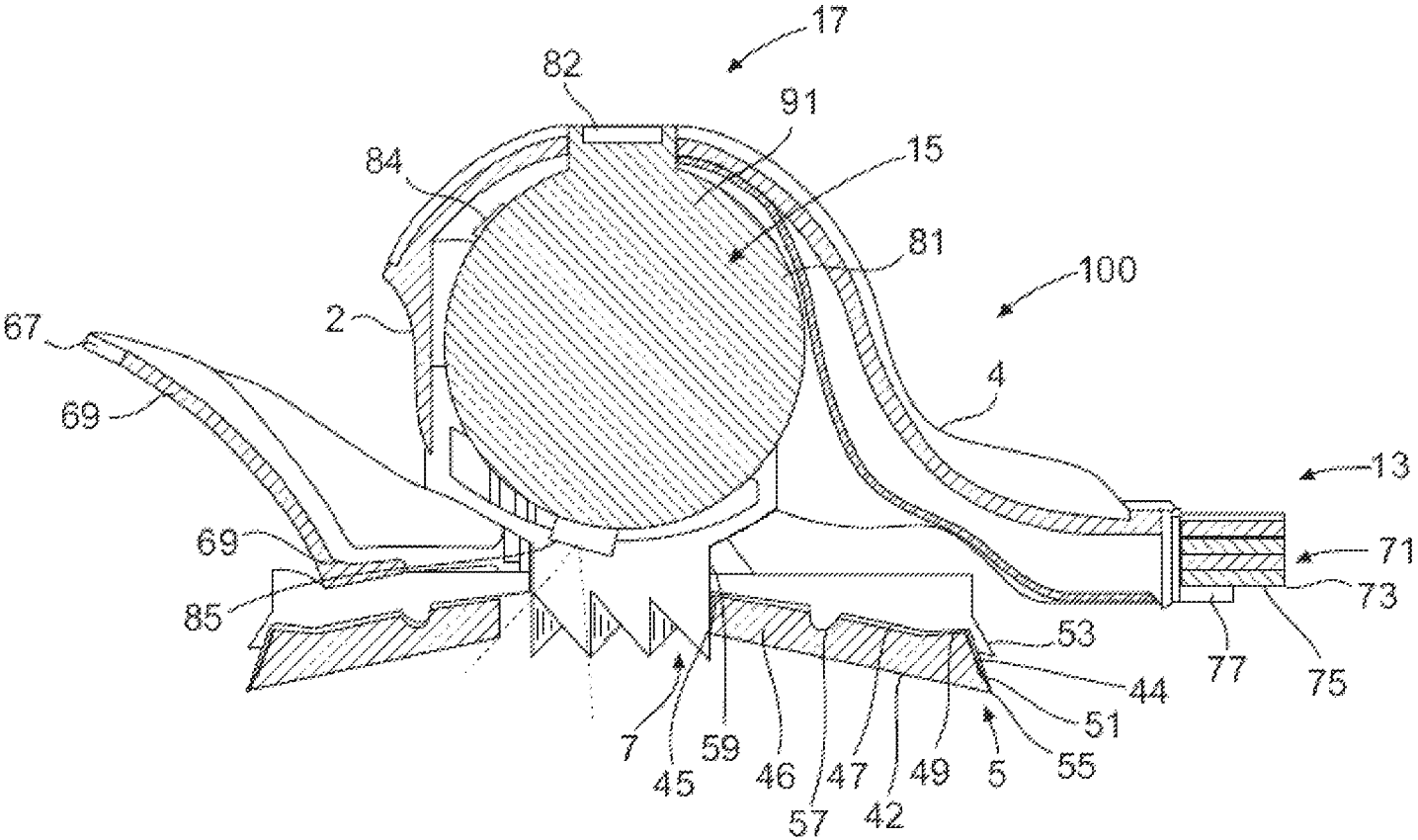

For illustrative purposes, the principles of the present invention are described by referencing various exemplary embodiments thereof. Although certain embodiments of the invention are specifically described herein, one of ordinary skill in the art will readily recognize that the same principles are equally applicable to, and can be employed in other apparatuses and methods. Before explaining the disclosed embodiments of the present invention in detail, it is to be understood that the invention is not limited in its application to the details of any particular embodiment shown. The terminology used herein is for the purpose of description and not of limitation. Further, although certain methods are described with reference to particular steps that are presented herein in a select order, in many instances, these steps can be performed in any order as may be appreciated by one skilled in the art, and the methods are not limited to the particular arrangement of steps disclosed herein.

It must be noted that as used herein and in the appended claims, the singular forms "a", "an", and "the" include plural references unless the context clearly dictates otherwise. Thus, for example, reference to "an abrasive element" includes a plurality of abrasive elements and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments.

Furthermore, unless otherwise defined, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described.

As used herein, the term "abrasive elements" can include any abrasive structure designed to cut, scrape or otherwise induce wear. Exemplary abrasive elements include, but are not limited to, protrusions, teeth, wedges, serrations, ridges, barbs, spikes, hooks, rasps, graters or any combination thereof.

Additionally, for purposes of the present application, the term "substance" as used herein can refer to any material that is positioned on or adhered to a surface. In an exemplary embodiment, substance can include frost, snow, ice, food, adhesives, paint, debris or combinations thereof.

The present invention is directed to a novel hand held scraper tool and method for use thereof. The technology may be predicated upon the importance of enhancing the ability to efficiently and effectively abrade a surface or remove one or more substances from a surface by: providing a plurality of abraders customized for different applications, such as flexible abraders that conform to curved and multi-planar surfaces as well as a brush for removing solid and liquid materials, and providing an ergonomic handle that efficiently transfers manually applied force to the abraders. In a first exemplary embodiment, shown in FIGS. 1(*a*)-1(*i*), of which FIGS. 1(*a*)-1(*b*) are side elevational views, FIGS. 1(*c*) and 1(*f*) are perspective side views, FIGS. 1(*d*), 1(*h*) and 1(*i*) are cross-sectional views, FIG. 1(*e*) is a perspective bottom view, and FIG. 1(*g*) is a perspective front view, scraper tool 100 includes a body 1, one or more attack surfaces for removing a substance, such as one or more scraper blades 3, one or more cantilevered abraders 5, one or more scraping projections 7, one or more shields 9 for deflecting a substance, one or more notches 11 adapted for removing a substance from a windshield wiper, one or more brushes 13 for removing solid and liquid materials, one or more dispensers 15 for dispensing a cleaning fluid or combinations thereof, and a handle 17.

Referring now to the drawings, wherein like reference numerals designate corresponding structure throughout the views, the exemplary embodiment of scraper tool 100 shown in FIGS. 1(*a*)-1(*i*) includes a body 1 having a portable, compact and light weight configuration. Body 1 can have any shape, dimension and configuration suitable to facilitate the cleaning capabilities of scraper tool 100 and can be constructed from any material, including plastics, metals, ceramics or combinations thereof. Exemplary materials include polycarbonate alloys, acrylonitrile butadiene styrene, metal alloys, such as stainless steel, or combinations thereof.

As shown in FIGS. 1(*a*)-1(*c*), body 1 has a two-tiered structure defined by an upper frame 21 that is positioned above and spaced apart from lower frame 23. Preferably, body 1 has a substantially open framework wherein upper frame 21 is sufficiently spaced vertically apart from lower frame 23 so as to enable removal of substances accumulated below upper frame 21 and handle 17. In one embodiment, upper frame 21 can be spaced apart from lower frame 23 by about 0.4 cm to about 5.0 cm, preferably, about 0.6 cm to about 3.8 cm, more preferably, about 0.6 cm to about 2.5 cm, and most preferably, about preferably about 0.4 cm to about 1.9 cm. Upper frame 21 can be arranged in any orientation relative to lower frame 23, including a substantially parallel or angled orientation, suitable to facilitate cleaning of scraper tool 100 or enhance scraping capabilities. Additionally, upper frame 23 can be integrally or removably attached to lower frame 23. Preferably, lower frame 23 is removably mounted to upper frame 21 to facilitate cleaning or replacement of one or more attack surfaces mounted thereon.

Upper frame 21 can have any shape, dimension or configuration. In one embodiment, upper frame 21 can have a substantially planar or curved configuration, such as a convex or concave configuration. To facilitate cleaning and removal of substances accumulated between upper frame 21 and lower frame 23, upper frame 21 can have an arcuate or otherwise arched configuration.

As shown in the exemplary embodiment of FIG. 1(*a*), upper frame 21 has an elongated structure that spans the width of scraper tool 100, including a first arm 25 and second arm 27. Optionally, upper frame 21 can further include a third arm 26 that extends substantially perpendicular to arm 25, 27 such that upper frame 21 has a T shaped configuration. Preferably, third arm 26 is centrally positioned relative to first and second arms 25, 27. Arms 25, 26, 27 can have any configuration, including a substantially planar or curved configuration, such as a convex or concave configuration.

One or more, preferably two or more, structural members 29 that extend from a lower surface 33 of upper frame 21 towards lower frame 23. Operatively associated with two or more connecting members 32 of lower frame 23, structural members 29 function to connect upper frame 21 to lower frame 23. Structural members 29 can be positioned anywhere along the length of arms 25, 26, 27, including a proximal, central or distal region thereof. In one embodiment, structural members 29 can be oriented substantially perpendicular to or at an acute or obtuse angle relative to arms 25, 26, 27.

As shown in the embodiment of FIG. 1(*b*), first and second arms 25, 27 each have an inner structural member 20 between which two connecting members 32 of lower frame 23 are friction fitted to attach upper frame 21 to lower frame 23. Preferably, an inner surface 18 of inner structural member 20 includes a male or female fastener designed to rotationally mate with a corresponding male or female fastener positioned on an exterior surface 16 of connecting member 32. Exemplary male and female fasteners can include protrusions, indentation and holes that enable a pivotal motion. As shown in FIG. 1(*c*)-1(*d*), preferably inner surface 18 of inner structural member 20 includes a circular protrusion or cylindrical rod that is rotationally and pivotally positioned within a hole defined in an exterior surface 16 of an arch shaped connecting member 32. Additionally, arms 25, 27 each have an outer structural member 22. The space formed between inner and outer structural members 20, 22, a lower surface 33 of upper frame 21 positioned therebetween and an upper surface 38 of lower frame 23 abutting structural members 20, 22 can be sized to received and frictionally retained side members 63 of shield 9 so as to mount shield 9 to upper frame 21.

Upper frame 21 is further defined by an upper surface 31 and lower surface 33 through which one or more holes can be positioned for various purposes. In one embodiment one or more connecting member holes 30 defined in upper frame 21 can be aligned with and designed to engage an upper end of one or more connecting members 32 to facilitate pivotal movement of connecting member 32 relative to structural member 29. One or more flange member receiving holes 14 defined in upper frame 21 can receive flange members 60 of removable frame member 59 for mounting scraper projections 7. One or more spray nozzle holes 12 defined in upper frame 21 can also surround a spray nozzle 85 of dispenser 15. In another embodiment, upper frame 21 and/or handle 17 further include one or more substance removal holes 91 that are sufficiently sized to facilitate removal of a substance accumulated below upper frame 21 and/or handle 17. A lower surface 33 of upper frame 21 can further include a plurality of struts to enhance the structural integrity of upper frame 21.

As shown in FIG. 1(*e*), lower frame 23 can include a first frame member 35 that is positioned to a side of and spaced apart from a second frame member 37. Frame members 35, 37 can be horizontally spaced apart from one another such that they are oriented parallel to one another in a single plane. Alternatively, frame members 35, 37 can be positioned in different planes. An elongated third frame member 39 connects first and second frame members 35, 37 and is preferably centrally positioned therebetween, such that frame members 35, 37, 39 of lower frame 23 form an I shaped configuration. Lower frame 23 and its members 35, 37, 39 can have any suitable shape, dimension and configuration, including a substantially planar or curved configuration, such as a convex or concave configuration.

One or more connecting members 32 positioned on and integral with an upper surface 38 of lower frame 23, including frame members 35, 37, 39 or combinations thereof, pivotally connect lower frame 23 to upper frame 21. Preferably, first arm 25 is pivotally connected to first frame member 35 and second arm 27 is pivotally connected to second frame member 37 via structural members 29 and connecting members 32. Lower frame 23 and the attack surfaces mounted thereto can therefore be pivotally mounted to upper frame 21 and handle 17, so as to allow a degree of rotational movement to enhance surface cleaning capabilities. Additionally, the pivotal mounting of lower frame 23 also allows handle 17 to rock back and forth relative to lower frame 23, to facilitate use.

As shown in FIGS. 1(*e*)-1(*f*), Lower frame 23 is further defined by side surfaces 40 and a lower surface 41 that can include in a plurality of abrasive elements to facilitate scraping and substance removal. In an exemplary embodiment, lower surface 41 can include one or more abrasive projections 96, preferably configured as teeth or ridges, that are positioned along a perimeter and throughout a central region of frame members 35, 37, 39 or combinations thereof. Abrasive projections 96 can substantially cover the entire lower surface 41 of frame members 35, 37, 39 or combinations thereof, preferably, about 60% to 90%, more preferably, about 75% to 90% of frame members 35, 37, 39 or combinations thereof. Two or more abrasive projections 96 can have a different height, width, thickness or combinations thereof for use in different applications. Additionally, two or more abrasive projections 96 can be oriented at different angles relative to one another to facilitate scraping in multiple directions. For example, two or more abrasive projections 96 can be oriented in a centrally radiating orientation or can be substantially perpendicular to one another.

As shown in FIGS. 1(*e*)-1(*f*), one or more, preferably a plurality of scraper blades 3 can be integral with, mounted to or otherwise extend from first and/or second frame members 35, 37. Scraper blade 3 can have any conventional blade configuration that includes a terminal scraping edge 43 for enabling scraping, cutting, and/or other abrasive action. The scraping edge 43 of scraper blade 3 can be configured as a linear or curved blade edge. Alternatively, edge 43 can be otherwise contoured, such as having a beveled edge or can include a plurality of abrasive elements. As shown in FIG. 1(*a*), three tapered scraper blades 3 are mounted to and extend from side surfaces 40 of first and second frame members 35, 37, wherein each scraper blade 3 is angled to face a different direction. In an exemplary embodiment, scraper blade 3 is substantially rigid, integral with a substantially rigid lower frame 23 and sized and contoured to facilitate removal of hard substances, such as ice, from a vehicle's headlights or side view minors. Additionally, scraper blade 3 can be constructed from any material, including plastics, metals, ceramics or combinations thereof. Exemplary materials include polycarbonate alloys, acrylonitrile butadiene styrene, metal alloys, such as stainless steel, or combinations thereof.

As shown in FIGS. 1(*e*)-1(*g*), scraper tool 100 further includes one or more cantilever abraders 5 that are capable of moving relative to body 1. Cantilever abraders 5 can be integral with body 1 or alternatively can be removably mounted to facilitate replacement and/or cleaning. Each cantilever abrader 5 is hinged about a proximal end 45 thereof to a surface of body 1 and is capable of bending and moving independently with respect to adjacent cantilever abraders 5, thereby enabling an set of cantilever abraders 5 to conform to and effectively remove a substance from curved and multiplanar surfaces. To enhance flexibility, the thickness of cantilever abrader 5 at its proximal end 45 where cantilever abrader 5 is hinged to body 1 can be substantially thin. In an exemplary embodiment, the thickness can be about 0.5 cm to about 2 cm, preferably, about 1 cm to about 2 cm, more preferably, about 1.5 cm to about 2 cm. In an alternative embodiment, one end of cantilever abraders 5 can be suspended from body 1 using springs or other suspension mechanisms. Cantilever abraders 5 can be hingedly attached to or extend from any surface of upper frame 21 or lower frame 23, including an edge or lower surface of first arm 25, second arm 27, third arm 26, first frame member 35, second frame member 37, third frame member 39 or combinations thereof. As shown in FIGS. 1(*e*)-1(*f*), cantilever abraders 5 are hinged to third frame member 39 and positioned between two scraper blades 3, so as to create a continuous scraping surface to enhance the abrasive capabilities of scraper tool 100 and facilitate cleaning.

Cantilever abraders 5 can have any configuration, including a simple planar blade-like structure or a more complicated three dimensional structure. In an exemplary embodiment, cantilever abrader 5 is constructed as an elongated blade or abrasive structure attached to body 1 by a living hinge and can be fabricated from a flexible plastic material. Cantilever abraders 5 can be fabricated from any suitable material that facilitates scraping, including plastics, metals, ceramics or combinations thereof. Exemplary materials include polycarbonate alloys, acrylonitrile butadiene styrene, metal alloys, such as stainless steel, or combinations thereof.

As shown in FIG. 1(*g*), cantilever abrader 5 has a three dimensional configuration defined by an upper surface 44, lower surface 42 and side surface 46, one or more of which can be contoured or include one or more abrasive elements to facilitate scraping. Upper surface 42 can be defined by two or more angled surface sections, including a proximal first section 47 adjacent to a proximal end region 45 of cantilever abrader 5, an intermediate second section 49, an intermediate third section 51, and a distal fourth section 53 that includes a distal blade scraping edge 55 of the cantilever abrader 5. Each section has a substantially planar or curved configuration. Additionally, one or more sections 47, 49, 51 and 53 can include one or more abrasive structures to facilitate scraping.

As shown in FIG. 1(*g*), a proximal end 45 of cantilever abrader 5 can be hinged to third frame member 39, wherein first section 47 can be arranged so as to be parallel or inclined relative to central frame member 39. In one embodiment, the angle formed between an upper surface of third frame member 39 and first section 47 is about 180° to about 225°, preferably, about 180° to about 210°, more preferably, about 180° to about 195°.

As shown in FIG. 1(*h*), to further enhance flexibility and increase the deflection range, groove 57 can be defined in first section 47 of cantilever abrader 5 that traverses a width thereof. In one embodiment, groove 57 may be configured as an elongated slot, score line, or indentation line. First groove 57 can be positioned anywhere along the length of first section 47. Preferably first groove 57 is located adjacent proximal end 45 and can have a depth and/or width of about 0.25 cm to about 2 cm, preferably, about 0.5 cm to about 1.5 cm, more preferably, about 0.5 cm to about 1 cm, most preferably, about 1 cm to about 2 cm. First groove 57 can have any suitable configuration, including a cylindrical, rectangular box like or triangular groove shaped structure. In one embodiment, first groove 57 extends through adjoining cantilever abraders 5, forming a continuous linear or curved groove that spans a set of cantilever abraders 5. Alternatively, first groove 57 can be defined in select cantilever abraders 5 in a discontinuous arrangement within a set of cantilever abraders 5. For example, first groove 57 can be defined in select cantilever abraders in an alternating configuration or is only defined in the cantilever abraders 5 positioned centrally and/or at the ends of a set of cantilever abraders 5. In another embodiment, first groove 57 can be defined in first, second, third, fourth sections 47, 49, 51, 53, or a combination thereof in the same manner as discussed above.

As shown in FIG. 1(*h*), a second groove 48 can be defined in lower surface 42 of cantilever abrader 5. Second groove 48 can be defined in lower surface 42 at a location that is opposite of or, to a side of or otherwise adjacent to the location of groove 57. Second groove 48 can have the same structure, dimension, configuration, position and arrangement on one or more cantilever abraders 5 as that of first groove 57. In one embodiment, grooves 57, 48 can be corresponding structures having two opposing C shaped curvatures. Grooves 57, 48 facilitate bi-directional bending of cantilever abrader 5 at the location of grooves 57, 48. To facilitate flexion of cantilever abrader 5, the thickness of cantilever abrader 5 between grooves 57, 48 can be reduced. In one embodiment, the thickness of cantilever abrader 5 between grooves 57, 48 adjacent to proximal end 45 can be about 0.25 cm to about 2 cm, preferably, about 0.5 cm to about 1.5 cm, more preferably, about 0.5 cm to about 1 cm.

Second section 49 and/or first section 47 inhibit the vertical deflection of cantilever abrader 5 when they contact lower surface 33 of upper frame 21, flange 65 of shield 9, lower edge 69 of shield 9 during flexion or combinations thereof. In one embodiment, second section 49 can have an upward inline relative to first section 47 so that the angle between the first and second section is about 135° to about 165°, preferably about 150° to about 165°. The angular inclination formed between the first and second sections 47, 49 can enhance the applied force for removing a substance.

Third section 51 facilitates the deflection of a substance that has been removed from a surface by blade scraping edge 55 of fourth section 53. As shown in FIG. 1(*g*), third section 51 can have a substantially vertical planar upper surface suitable for pushing away loosened substances. In one embodiment, the angle between second section 49 and third section 51 about 255° to about 285°.

Fourth section 53 functions to contact, scrape away and deflect a substance from a surface to be cleaned. Preferably, fourth section 53 is configured to have a planar blade-like surface terminating in a linear or curved distal blade scraping edge 55 that enables cutting, scraping and substance removal. Blade scraping edge 55 can also be otherwise contoured, such as having an angled or beveled edge. For example, blade edge 55 can include a plurality of abrasive elements to further facilitate scraping and/or movement of a substance up and away from the blade scraping edge 55. In one embodiment, the cantilever abraders 5 are arranged in a densely packed array, wherein the scraping edge 55 of each cantilever abrader 38 is positioned substantially close to or overlaps with the scraping edge 55 of an adjacent cantilever abrader 5, such that debris does not substantially pass or accumulate between adjoining cantilever abraders 5. As shown in FIG. 1(*g*), the cantilever abraders 5 can be arranged in an alternating nested configuration, wherein a distal surface of cantilever abrader 5 including scraping edge 55 overlaps with a distal surface of an adjacent cantilever body 35 of an adjoining cantilever abrader 5 to substantially prevent passing of debris therebetween.

In one embodiment, fourth section 53 can be inclined at a downward angle relative to third section 51, forming an angle of about 90° to about 180°, preferably about 90° to about 175°, more preferably about 90° to about 135°, and most preferably about 135° to about 175°. The obtuse angular inclination between the third and forth sections 49, 51 can function to apply greater force in removing a substance. Additionally, one or more abrasive elements can be positioned on a face of fourth section 53 and/or third section 51 to further facilitate the abrasive capabilities of cantilever abrader 5. As shown in FIG. 1(*g*), preferably an abrader 62, configured as a spear, pyramidal, diamond, wedge or anvil with one or more projecting and forward facing cutting edges or points, is positioned on a face of fourth section 53 and/or third section 51.

In an alternative embodiment, second section 49 is configured to be a linear 180° extension of first section 47, and third section 51 is configured to be a linear 180° extension of fourth section 53, such that upper surface 44 of cantilever abrader 5 only has two sections: a first section hinged to body 1 and a second section including a distal blade scraping edge 55. In one embodiment, the angle between these sections can be about 180° to about 270°, preferably about 225° to about 270°.

The angle formed between the various sections 47, 49, 51, 53 of cantilever abrader 5 and the angle between first section 47 and a surface of body 1 to which it is mounted can be uniform or can vary among two or more cantilever abraders 5. Additionally, each section 47, 49, 51, 53 can have a different length, width, configuration or combination thereof relative to one another, the unique features of which can serve a different abrasive purpose.

Lower surface 42 of cantilever abrader 5 can be contoured and/or include one or more abrasive elements to facilitate scraping. In one embodiment, one or more abrasive projections 96, preferably configured as teeth or ridges, can be positioned on lower surface 42 of cantilever abrader 5, extending down towards a surface to be cleaned. Preferably, the abrasive projections 96 can be positioned along a perimeter of the lower surface 42 of cantilever abrader 5. In one embodiment, abrasive projections 96 have a ridge like configuration that runs continuously along the perimeter of lower surface 42, forming a U shaped configuration with a central elongated indentation or slot. The ridge of two or more preferably of all the cantilever abraders 5 in a set can also be connected, forming a single continuous ridge having an undulating wave configuration along the lower surface 42 of a set of cantilever abraders 5. One or more abrasive elements can be positioned on abrasive projections 96 to further enhance the abrasive capabilities of cantilever abrader 5. In one embodiment, two or more abrasive projections 96 can have a different height, width, thickness for use in different applications. Additionally, two or more abrasive projections 96 can be positioned at different angles relative to one another to facilitate scraping in multiple directions. For example, two or more abrasive projections 96 can be oriented in a centrally radiating orientation or can be substantially perpendicular to one another.

As shown in FIGS. 1(*e*), 1(*f*) and 1(*h*), scraper tool 100 can include two densely packed sets of cantilever abraders 5 that are spaced apart and hingedly mounted to third frame member 39 in opposing directions, facing a front and rear direction of scraper tool 100. A set of cantilever abraders 5 can be arranged in any configuration, including a contiguous array that forms a unified scraping blade edge. Preferably, the cantilever abraders 5 are positioned adjacent to one another so that the distal blade scraping edges 55 of the cantilever abraders 5 form a continuous and uniform edge that does not substantially allow the passage of a substance there between. Alternatively, cantilever abraders 5 can be arranged in a non-contiguous array, wherein one or more cantilever abraders 5 are spaced apart from or one another in a parallel or splayed in a radial or rake like manner. A set of cantilever abraders 5 can have an overall curved configuration, rounded configuration, pointed configuration or other geometric shape that optimize cleaning capability. In one embodiment, cantilever abraders 5 can be arranged to form a square, rectangular, circular, elliptical, triangular or diamond configuration. Preferably, a set of cantilever abrader 5 can have a collective curved geometry, wherein two or three adjoining cantilever abraders 5 along the curve create a leading edge of abrasive contact that is followed by more abrasive contact from the other adjoining cantilever abraders 5 as scraper tool 100 is rotated or moved in a circular pattern. One or more centrally positioned cantilever abraders 5 within the set can also have a larger width and/or thickness, length to further facilitate the removal of hard or entrained substance, such as ice.

One or more sets of cantilever abraders can be positioned adjacent to and between two constraint members 50, which function to restrain the vertical displacement of a set of cantilever abraders 5. Constraint member 50 can have a substantially rigid and inflexible structure that is integral with and positioned parallel to one or more rigid surfaces of body 1. Preferably, constraint member 50 is also integral with the same surface of body 1 to which cantilever abraders 5 are hingedly mounted. Additionally, constraint member 50 is positioned adjacent to and elevated with respect to cantilever abraders 5 such that at rest, a distal end of constraint member 50 is elevated relative to blade scraping edge 55 of cantilever abraders 5. By virtue of its rigidity, adjacent position to a set of cantilever abrader 5, connection to cantilever abraders 5 through body 1 or combinations thereof, constraint member 50 is capable of limiting the extent to which one or more cantilever abraders 5 or all the cantilever abraders 5 in a set can rise, thereby preventing excessive deformation of the adjoining cantilever abraders 5. As discussed below, other features of scraper tool 100, such as a lower surface 41 of lower frame 23 lower edge 69 of shield 9, flange 65 of shield 9 or combinations thereof, can further restrain the upward deflection of cantilever abraders 5. Constraint member 50 can have any suitable size, dimension, or configuration for restraining the vertical displacement of cantilever abraders 5. Additionally, constraint member 50 can be constructed from any material, including plastics, metals, ceramics or combinations thereof. Exemplary materials include polycarbonate alloys, acrylonitrile butadiene styrene, metal alloys, such as stainless steel or combinations thereof.

As shown in the embodiment of FIGS. 1(*e*), 1(*f*) and 1(*h*), two opposing sets of cantilever abraders 5 can be positioned between and bound by a first constraint member 50 integrally formed with first and third frame members 35, 39 and a second constraint member 50 integrally formed with second and third frame members 37, 39. Constraint member 50 has a substantially rigid and elongated configuration that spans the length of an adjoining cantilever abrader 5. As shown in FIGS. 1(*e*) and 1(*g*), constraint member 50 is positioned adjacent to and extends along a length of two opposing cantilever abraders 5 in two opposing sets of cantilever abraders 5. In this embodiment, constraint member 50 has a rectangular body with a greater thickness than the adjoining cantilever abraders 5. A ridge 52 can be defined along the length of constraint member 50, preferably along the perimeter thereof, to further enhance the rigidity and structural integrity of constraint member 50. Ridge 52 can be a continuous structure that runs along the perimeter of two opposing constraint members 50 of two opposing cantilever abrader sets, forming a C or rectangular configuration. As shown, constraint member 50 is integral with and oriented parallel to frame members 35, 37, 39, whereas cantilever abraders 5 are angularly inclined relative to third frame member 39 such that at rest the lower surface of a distal end of constraint member 50 is elevated relative to blade scraping edge 55 of cantilever abraders 5. In one embodiment, the elevation can be about 0.25 cm to about 2 cm, preferably, 0.5 to about 1.5 cm, more preferably, about 0.5 to about 1 cm. In another embodiment, the constraint members 50 can be adjustably or dynamically positioned to control the range of motion of cantilevered abraders 5.

In one embodiment, an end of constraint member 50 further includes a blade surface 56 that terminates in a tapered blade edge 58 to facilitate scraping and a substantially sloped or vertical surface 54 for deflecting substances loosened by constraint member blade edge 58. One or more abrasive elements, preferably configured as a spear, pyramidal, diamond, wedge or anvil with one or more forward facing cutting edges or points, can be positioned on a face of vertical surface 54 and/or blade surface 56 to enhance the scraping capabilities of scraper tool 100. A lower and/or side surface of constraint member 50 can also include abrasive elements. In one embodiment, one or more protrusions can project down from a lower surface of constraint member 50 adjacent to a distal end thereof.

FIGS. 2(*b*)-2(*c*) illustrates the operation of cantilever abraders 5. Upon applying a force to handle 17, one or more cantilever abraders 5 can be pressed against a surface to be abraded or cleaned. Applied pressure from handle 17 can be concentrated at a distal end of cantilever abrader 5, particular the distal blade scraping edge 55 of cantilever abrader 5, creating an effective breaking force. The cantilever abraders 5 will deflect upward due to the resistive pressure from the surface against which the cantilever abraders 5 are pressed. In one embodiment, the distal end of one or more cantilever abrader 5 is capable of being vertical displaced about 0.25 cm or more, preferably, about 0.6 cm or more, more preferably, about 1.3 cm or more, more preferably, about 2.5 cm or more, more preferably, about 3.8 cm or more, and most preferably, about 5 cm or more. In an exemplary embodiment, the cantilever abrader 38 can have a spring constant of about 2.2 kN/m to about 15 kN/m, preferably about 5 kN/m to about 15 kN/m to enhance flexibility. The range of motion of highly flexible cantilever abraders 5 is dependent upon the applied pressure and curvature of the surface to be scraped or cleaned. Upward deflection of cantilever abrader 5 can be restricted by the adjacent surfaces, such as constraint members 50, lower surface 41 of lower frame 23, lower edge 69 of shield 9, flange 65 of shield 9 or combinations thereof. These features limit displacement of cantilever abraders 5 in order to focus the energy of attack and/or prevent undue stress, fatigue of the cantilever abrader 5. The hinged connection of cantilever abrader 5 is designed to allow the blade to conform to the contour of the scraping surface so that the applied force is enables efficient cleaning, and the aforementioned constraint features prevent cantilever abraders 5 from excessive bending that can lead to permanent deformation. In addition to being highly flexible, cantilever abraders 38 are also designed to provide a sufficient amount of force to enable effective scraping. Cantilever abraders 5 are constructed to have a sufficient rigidity and strength as well as flexibility to avoid permanent deformation and fatigue, particularly at the point where the proximal end of the cantilever body 5 is hinged to body 1 even after extended use and repeated bending.

As shown in FIGS. 1(*e*) and 1(*h*), scraper tool 100 can further include a plurality of scraper projections 7 designed to fracture hard substances, such as ice. In an exemplary embodiment, scraper projections 7 independently move relative to and in coordination with cantilever abraders 5 such that scraper projections 7 are only exposed to a surface to be cleaned or abraded when a sufficient amount of force is applied to scraper tool 100 so that cantilever abraders 5 deflect up. Additionally, scraper projections 7 can be designed to pivotally move with the rotation of handle 17.

In one embodiment scraper projections 7 can be positioned on a lower surface of frame members 35, 37, 39 or combinations thereof. Scraper projections 7 can also be integral with and extend from a lower surface 33 of upper frame 21, such as a lower surface of arms 25, 26, 27 or combinations thereof, a lower surface 41 of lower frame 23, such as frame members 35, 37, 39 or combinations thereof or a surface of handle 17 or combinations thereof.

Alternatively, scraper projections 7 can be integrally fabricated with a removable frame member 59 that can be removably attached to lower surface 33 of upper frame 21 or lower surface 41 of lower frame 23. As shown in FIGS. 1(*e*) and 1(*h*), when scraper projections 7 are integrally or removably attached to upper frame 21, one or more scraper projection holes 10 defined in lower frame 23, preferably third frame member 39, can be sized to allow scraper projections 7 to extend there through and contact a surface to be cleaned. In an exemplary embodiment, removable frame member 59 can be attached to lower or upper frame 21, 23 using a clip, clamp, latch, threaded, adhesive or other conventional mechanism. In one embodiment, removable frame member 59 can have a substantially planar configuration with two or more flange members 60 that can be friction fitted in flange member receiving holes 14 defined in upper frame 21, an internal cavity of handle 5, a hole positioned in lower frame 23 or combinations thereof. Alternatively, removable frame 59 can be clipped or clamped to an edge of the surface defining flange member receiving hole 14, an edge or side surface of the internal cavity of handle 5, an edge of the surface defining a hole positioned in lower frame 23 or combinations thereof. Designed to apply a shear force to a surface to be cleaned, scraper projections 7 can be designed so as to rock back and forth with the motion of handle 17 and are most effective in abrading a surface when cantilever abraders 5 reach their maximum point of vertical deflection. Scraper projections 7 can also be used to pound a surface in order to break-up or loosen hardened substances.

Scraper projections 7 can have any size, shape or configuration suitable for scoring, breaking, and/or scraping away a substance. In an exemplary embodiment, scraper projection 7 can be configured as teeth or ridge like structures. The distal end and sides surfaces of scraper projection 7 can optionally include a plurality of abrasive elements to further facilitate substance removal. Additionally, two or more scraper projections can have a different length, width, height, and/or configuration in order to facilitate the removal of different types of substances. In one embodiment, the height of one or more sets of scraper projections 7 can be graduated. Additionally, two or more scraper projections 7 can be oriented at different angles relative to one another to facilitate scraping in multiple directions. For example, two scraper projections 7 can be angularly inclined in different directions. As shown in FIG. 1(*e*), 6 sets of scraper projections 7 are shaped like wedge or triangular teeth, wherein each set includes 1, 2 or 3 adjoining teeth connected in a series. Each set of adjacent scraper projections are oriented in an opposite direction relative to one another. Scraper projections 7 can be arranged in any suitable manner including a patterned or random arrangement. In an exemplary embodiment, scraper projections 7 can be arranged in rows or can be positioned in a staggered configuration. As shown, scraper projection 7 covers an entire or substantial portion of a lower surface of removable frame 59. Alternatively, scraper projections 7 can cover an entire or substantial portion of lower surface 41 of lower frame 23 or lower frame 33 of upper frame 21. Additionally, scraper projections 7 can be constructed from any material, including plastics, metals, ceramics or combinations thereof. Exemplary materials include polycarbonate alloys, acrylonitrile butadiene styrene, metal alloys, such as stainless steel, or combinations thereof.

Scraper tool 100 further includes one or more shields 9 for deflecting a substance that has been removed by an abrasive element of scraper tool 100. As shown in FIGS. 1(*g*)-1(*h*), shield 9 has a body defined by a shield surface 61 that is substantially vertically positioned relative to upper and lower frame members 21, 23 and can have any size, dimension or configuration, including a planar or curved configuration, suitable for deflecting a substance. Preferably, shield surface 61 has an inclined sloped configuration with a curved overhang positioned at a distal upper edge 67 thereof and can be substantially the same height as or taller than handle 17. Additionally, shield 9 can be constructed from any material, including plastics, metals, ceramics or combinations thereof. Exemplary materials include polycarbonate alloys, acrylonitrile butadiene styrene, metal alloys, such as stainless steel or combinations thereof. A lower edge 69 of shield surface 61 can be positioned adjacent to and extend over a set of cantilever abraders 5 and/or frame members 35, 37, 39 of lower frame 23, thereby restricting upward deflection of cantilever abraders 5 positioned below shield 9.

Shield surface 61 is positioned between two elongated side members 63. A distal end of the two elongated side members 63 are substantially perpendicular to and integral with the two opposing sides of shield surface 61. The proximal end of side members 63 are couple to body 1 of scraper tool 100. As shown in FIG. 1(*h*), the proximal end of side members 63 can be integral with or removably received between two structural members 29, a lower surface 33 of upper frame 21 positioned therebetween and an upper surface 38 of lower frame 23 abutting structural members 29. A planar flange 65 of shield 9 integral with a lower edge 69 of shield surface 61 can be attached to side members 63 to enhance the structural integrity of shield 9. Additionally, flange 65 of shield 9 can be oriented substantially perpendicular to shield surface 61 so as to restrict the upward displacement of cantilever abraders 5.

One or more notches 11 can be defined in a distal upper edge 67, lower edge 69 or side edge of shield surface 61 or in an edge of side members 63 to remove a substance from a windshield wiper. Notch 11 can be sized and configured to receive, conform to, and clean a wiper blade of a vehicle. As shown in FIG. 1(*a*), notch 11 is defined by a narrow distal end that gradually widens as it extends away from the body of scraper tool 100. The distal end can have a circular, semicircular, triangular or rectangular shape suitable for cleaning and conforming to the edge of a wiper blade. In one embodiment, the diameter or width of the distal end can be about 0.1 cm to about 0.25 cm and the width of notch 11 at an opposite end is about 0.5 cm to about 0.75 cm. Optionally, the perimeter of notch 11 includes one or more abrasive elements that would further facilitate cleaning a wiper blade. In operation a user can insert a wiper blade into notch 11. By moving scraper tool 100, notch 11 can be drawn along the length of the wiper blade to enable cleaning.

Scraper tool 100 can further include one or more brushes 13 for removing liquid or solid substances that are mounted to or integral with any surface of body 1. As shown in FIG. 1(*a*), brush 13 is preferably attached to a distal end of upper frame 21, preferably third arm 26, and handle 17. Brush 13 includes a plurality of bristles 71 that collectively can be capable of functioning both as a conventional brush and as a squeegee suitable for removing solid substances as well as forming a water impenetrable barrier for removing liquids. Bristles 71 are capable of a wide range of motion and are independently moveable relative to one another to facilitate cleaning of multi-planar surfaces. In one embodiment, bristles 71 can be independently flexed in two or more directions, three or more directions or 360° about a pivot point. Bristles 71 can further be closely oriented relative to one another so as to be capable of creating a substantially water impermeable barrier that can be used to direct and sweep away liquid or semi-liquid materials. Each bristle 71 can be located adjacent to one or more adjoining bristles 71 so as to create a substantially continuous line of contact along a portion or an entire length of bristle 71 either at rest or when flexed. In an exemplary embodiment, bristle 71 contacts a plurality of adjoining bristles 71 located in front of, behind and/or to a side of bristle 71 to create a watertight boundary along a portion or entire length of bristle 71 either at rest or when flexed. Bristles 71 can further create a substantially continuous and secure contact with a surface so as to efficiently sweep away solid and/or liquids materials, leaving behind no or minimal residue. In one embodiment, the contact between one or more bristles 71 and a surface can allow a liquid to run around the tips 73 of a group of bristles 71. In another embodiment, the contact between one or more bristles 71 and a surface can entirely block the flow or seepage of a liquid between a group of bristles 71.

Bristles 71 can be arranged in any suitable uniform or random configuration that would enable operation as a conventional brush and/or squeegee. Bristles 71 are arranged in one or more uniform rows or can be arranged in staggered rows so as to be offset relative to one another. A staggered, offset arrangement can maximize the ability of brush 13 to catch and sweep away liquids. Bristles 71 can be arranged in one or more, preferably a plurality of, straight or staggered rows so as to create a self-reinforcing brush having the combined strength so as to be capable of removing ice and other materials that can be tightly bonded to a surface.

Bristles 71 can have any shape, size, configuration or material composition suitable for removing solid and/or liquid substances from a surface. As shown in FIG. 1(*a*), bristle 71 includes a shaft 75 and a tip 73. Shaft 75 can have a cylindrical, rectangular, trapezoidal, wedge and/or flap like structure. Shaft 75 can also have any length, width, thickness or angular orientation. Shafts 75 of two or more bristles 71 can have different lengths, widths, thicknesses, angular orientations, or combinations thereof. This variation in the size and orientations in a group of bristles 71 enhances the ability of brush 13 to clean a multi-planar surface. For example, a set of bristles 71 can have a group of shorter and/or thicker bristles surrounded by a group of longer and/or thinner bristles. Bristles 71 can also be oriented perpendicular, parallel to, or an acute or obtuse angle with respect to a surface of body 1. Shaft 75 can have a straight configuration along the length of bristle 71. Alternatively, shaft 75 can include two or more members that are angularly oriented relative to one another. Bristle 71 further includes a tip 73 that can be curved, rounded, beveled or otherwise blunted so as to be nonabrasive and avoid scratching, marring or otherwise damaging a surface. Tip 73 can also be configured to have a nonabrasive or minimally abrasive soft, fine point.

Bristles 71 can be synthesized from any material suitable for removing solid and/or liquid substances, including plastic materials and elastomeric polymers, such as rubber, or a combination thereof. Exemplary materials include thermoplastic elastomers.

In an exemplary embodiment, bristles 71 can be configured as a plurality of independently movable flaps. The flaps can be created by creating a plurality of slits in a continuous elastomeric polymer or plastic member. Shaft 75 can have a rectangular, trapezoidal or wedge like configuration, and tip 73 can be curved or beveled. Preferably, brush 13 can include one or more rows of these flap like bristles 71 capable of removing substances that are strongly adhered to a surface. While the flap like bristles 71 can be independently moveable relative to one another so as to maneuver around and between objects, when a unidirectional force is applied to tips 73, bristles 71 are capable of creating a substantially continuous and water-tight wall that enables a user to capture, direct the movement of and sweep away liquid or semi-liquid materials.

Optionally, brush 13 can further include a set of or a plurality of conventional bristles that can be interspersed between bristles 71, located adjacent to bristles 71 and/or separated from bristles 71. In one embodiment, the conventional bristles can be located adjacent to bristles 71 of the present invention. Alternatively, bristles 71 can be located within a set of conventional bristles. In this embodiment, bristles 71 can be arranged in one or more rows within the set of conventional bristles.

Scraper tool 100 can further include one or more optional squeegee members 77 that can operate to catch and remove any residual materials after bristles 71 have swept a surface. In an exemplary embodiment, one or more squeegee members 77 can be located adjacent to, preferably behind, bristles 71. Squeegee member 77 can have any conventional configuration that is capable of creating a water tight seal with and facilitates removal of liquid materials from a surface.

As shown in FIG. 1(*i*), scraper tool 100 of the present invention can further include a liquid dispenser 15 that can be positioned within an internal cavity of handle 17. Dispenser 15 includes a reservoir 81 capable of retaining and dispensing a liquid, such as water or a cleaning solution. An upper surface 31 of upper frame 21, an upper surface of removable frame member 59, an upper surface 38 of lower frame 23 or combinations thereof can support and contain reservoir 81 within the internal cavity of handle 17. Liquid can be introduced into dispenser 15 through a hole positioned at an upper end of dispenser 15 and/or handle 17 which can be sealed with a detachable cap 82. An air inlet hole 84 can further be defined in an upper surface of reservoir 81 to stabilize the pressure therein. By compressing one or more buttons 83 positioned on or extending through a side, upper, front or rear surface of handle 17, wherein button 83 is positioned adjacent to a wall of reservoir 81, pressure is applied to a wall of reservoir 81, forcing a liquid though spray nozzle 85 positioned at a distal lower surface of reservoir 81. The liquid exits reservoir 81 and passes through a spray nozzle hole 12 defined in upper frame 21 that surrounds spray nozzle 85, through a centrally positioned removable frame hole 8 defined in removable frame 59 and through a spray nozzle hole 6 in lower frame 23, preferably third member 39, so that the liquid contacts a surface that is being cleaned. In another embodiment, the liquid can be pressurized such that reservoir 81 can be connected to a pump or motor for automating release of the liquid that can be initiated by pressing one or more buttons 83 on handle 17. In a preferred embodiment, the nozzle 85 can have a plurality of holes 87. Two or more holes 87 can have different sizes and dimensions. In one embodiment, holes 87 can be about 5 mm to about 1.3 mm. Additionally, the release pressure can be about 0.1 to about 10 psig to enable atomization. In one embodiment, dispenser 15 can be used to produce a fine liquid mist for cleaning a surface. Alternatively, holes 87 can be sized so that a substantial stream of liquid is released to facilitate cleaning.

Scraper tool 100 further includes a handle 17 designed to facilitate use and application of force to abrade a surface or remove a substance on a surface. Handle 17 can be integrally formed with any portion of body 1. Preferably, handle 17 can be positioned at a central region between first, second and third arms 25, 27 26 of upper frame 23. As shown in FIGS. 1(*a*)-1(*d*), handle 17 has an overall compact curved structure that is designed to fit within a user's hand. In one embodiment, handle 17 can be about 5 cm to about 10.2 cm in diameter, preferably about 2.5 cm to about 7.6 cm in diameter. As shown in FIG. 1(*a*), handle 17 preferably has a domed or spherical configuration that is designed to ergonomically conform to a user's palm and fit within a user's hand. Handle 17 can be constructed from any material, including plastics, metals, ceramics or combinations thereof. Exemplary materials include polycarbonate alloys, acrylonitrile butadiene styrene, metal alloys, such as stainless steel or combinations thereof.

In an alternative embodiment shown in FIGS. 2(*a*)-2(*c*), one or more substance removal holes 91 can be positioned through and defined in a side, front or back region of handle 17, disrupting the continuous domed curvature of handle 17. Substance removal holes 91 can be sized and configured to enable removal of substances trapped beneath handle 17 of scraper tool 100. In one embodiment, substance removal holes 91 can be defined in opposite sides of handle 17 and can have an oval, circular, triangular or rectangular shape. In one embodiment, substance removal hole 91 has a major diameter of about 2.5 cm to about 7.6 cm, preferably, about 2.5 cm to about 5.0 cm. Handle 17 can further have holes defined in an upper, side, front or rear surface thereof that allow button 83 to extend through a surface of handle 17 or receive a flange member 60 of removable frame 59.

An elastic overmold 93 can further cover one or more portions of handle 17 to further facilitate gripping and enhances user comfort. In one embodiment, elastic overmold 93 includes a plurality of protrusions 95. The contours and protrusions 95 of overmold 93 prevent a user's hand from slipping from handle 17. In one embodiment, protrusions 95 can be configured as raised semi-circular domed protrusions and/or circular ridges covering a central and/or rear region of the domed structure of handle 17 intended to contact a user's fingers and/or palm. A plurality of protrusions 95 can be arranged in a circular, oval, diamond, or rectangular configuration positioned on the central domed region of handle 17.

As shown in FIG. 1(*a*)-1(*d*), the central domed region of handle 17 is connected to a curved elongated handle member 4 having a gentle sloped concave configuration that extends towards and connects to brush 13, defining a palm rest region that can be covered by elastic overmold 93. In one embodiment the dome region and elongated handle member 4 may have an undulating, S shaped configuration, including a gentle rise, protrusion or bump at a distal end of elongated handle member 4 to facilitate placement of the heel of a user's palm. During use, the heel of a user's palm rests against the inclined sloped surface of elongated handle member 4, and the fingers curve over the central domed elastic overmold region. A user's thumb and pinky can rest can be received in and rest against elongated indentations 2 defined in the side of the domed handle 17. Another elongated indentation 2 defined in a front of the domed handle 17 can receive a user's finger tips. Alternatively, a continuous elongated indentation 2 may curve around the front and one or both sides of domed handle 17. At least a portion of handle 17, preferably the front of handle 17, is at least partially surrounded by shield 9, which functions to deflect and substantially prevent loosened substances from covering the user's fingers and hand during use.

The scraping tool of the present invention can be used for a wide variety of applications. In particular, scraping tool 100 can be particularly well suited to remove frost, snow and ice from a multi-planar or curved surface, such as the window shield of an automobile. Additionally, scraper tool 100 can effectively remove frost, snow, ice and other substances from various material surfaces, including glass and metal surfaces, without scoring, marring or otherwise damaging the surface being cleaned. Scraper tool 100 can further be particularly effective for cleaning hard to remove substances that are entrained in or otherwise adhered to a surface. In another embodiment, scraper tool 100 can also be used to be abrade a surface, such as wallboard, or to smooth, add texture or contours to or otherwise form a surface. For example, the scraper tool can be used to peel paint or adhesives from a surface.

Figure 3:
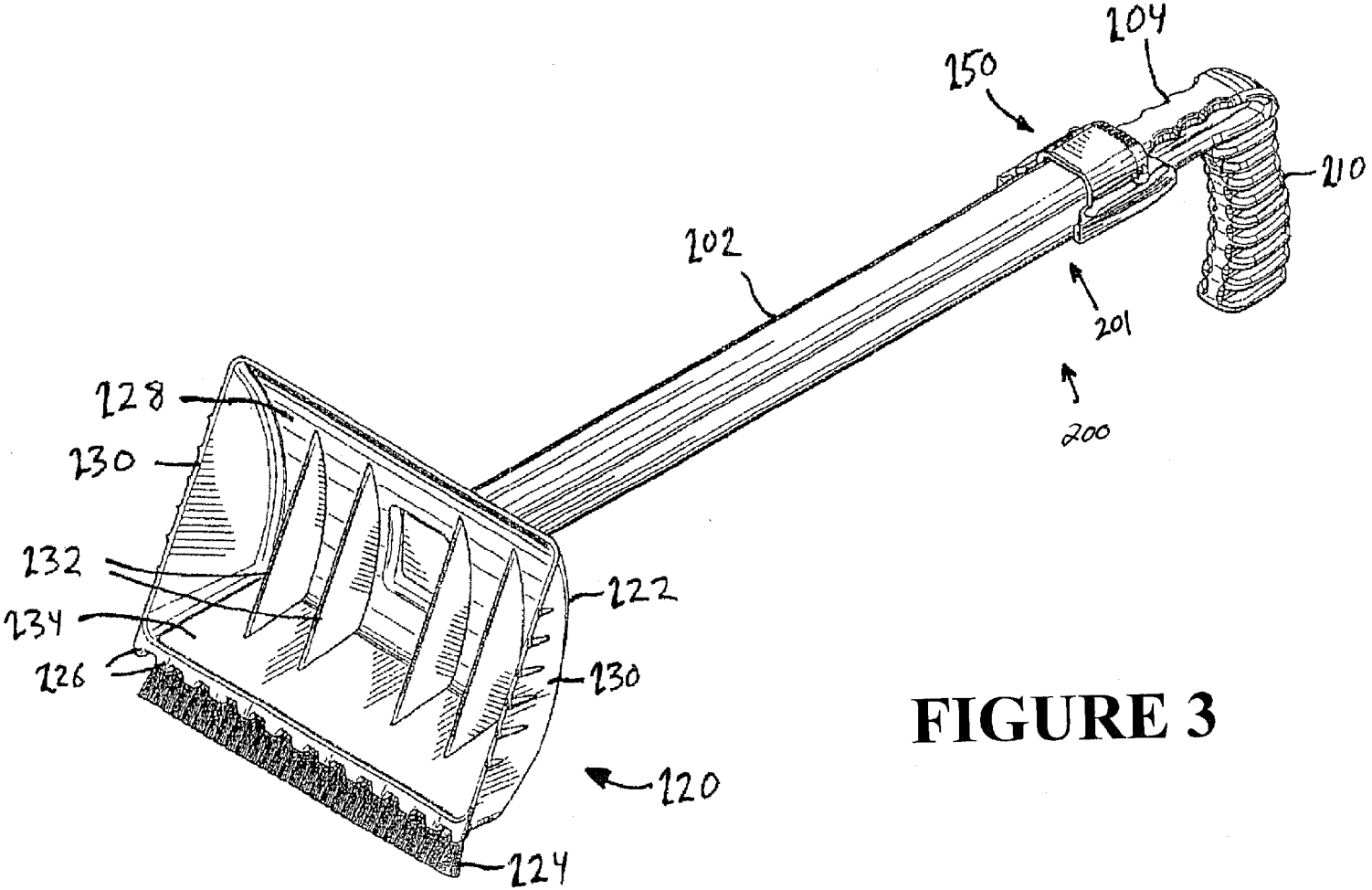
FIG. 3 is a top, front, left perspective view of an embodiment of a scraper tool according to the present invention, shown with its handle in a first configuration.
Figure 10:
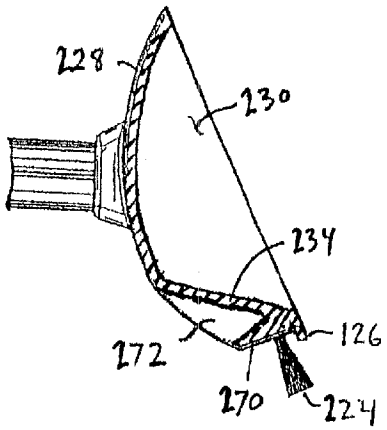
FIG. 10 is a right side sectional view of the head of FIG. 3.
Figure 4:
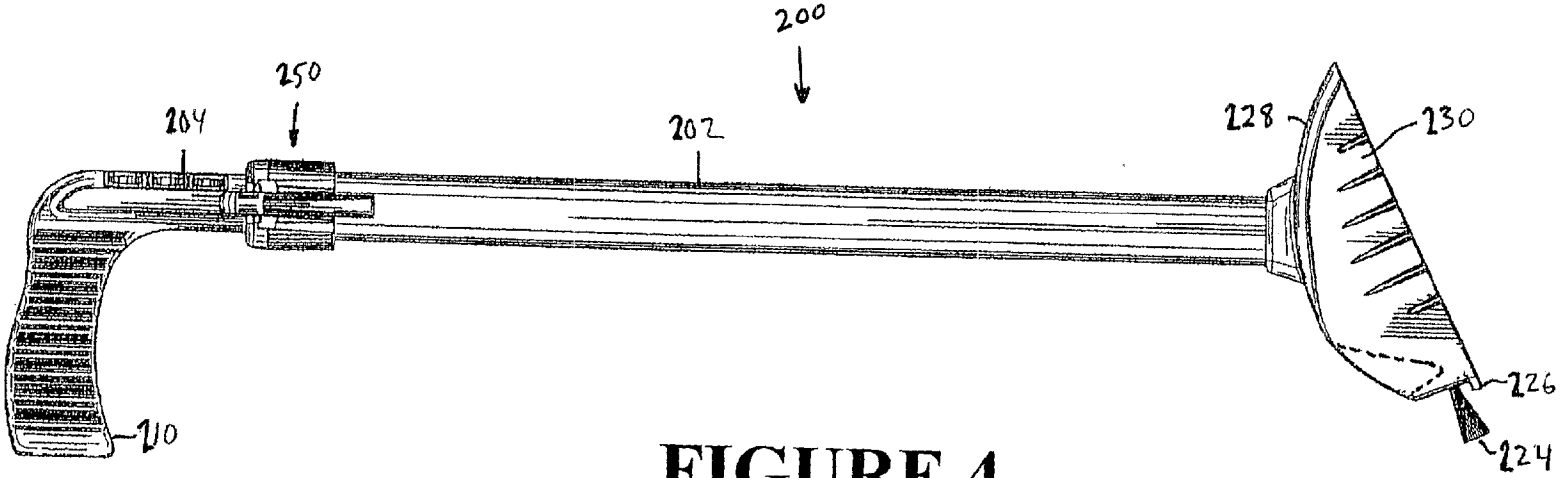
FIG. 4 is a right side elevational view of FIG. 3.
Figure 5:
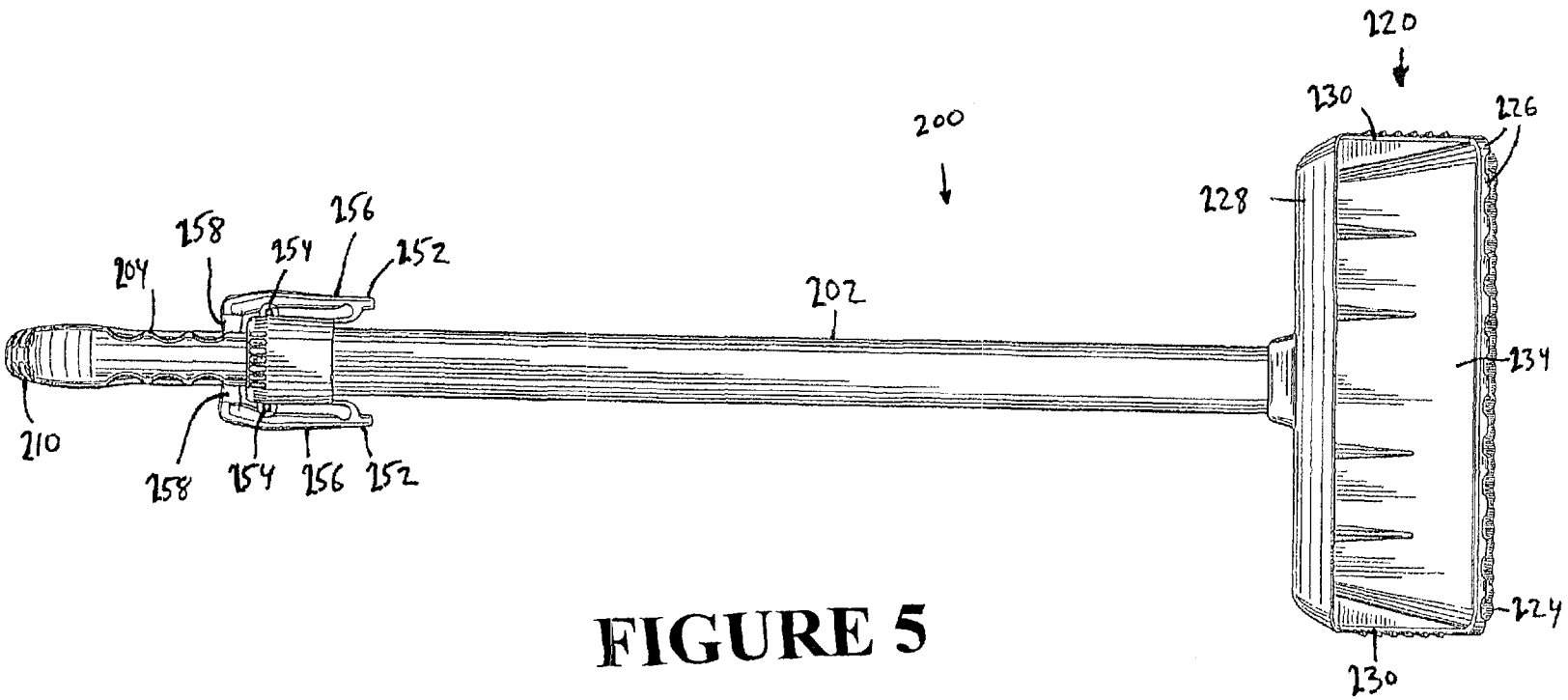
FIG. 5 is a top plan view of FIG. 3.
Figure 6:
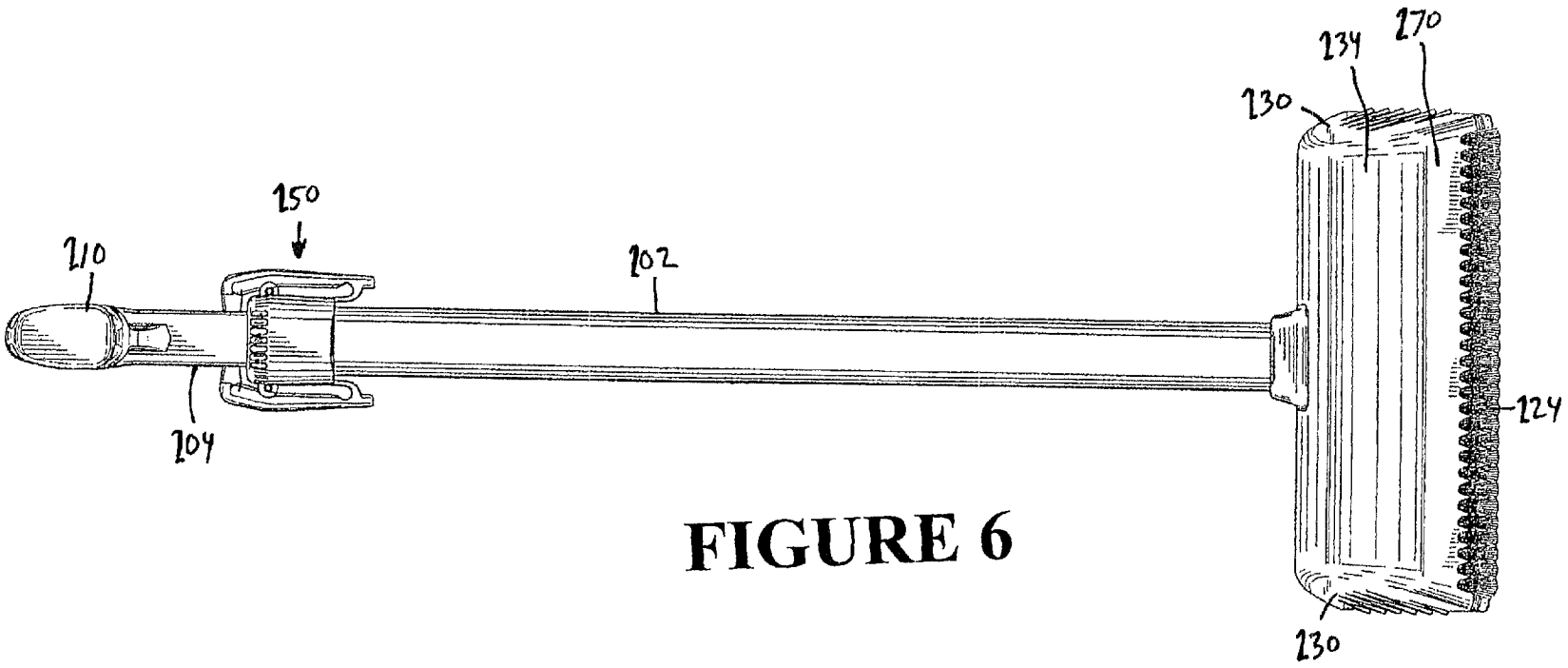
FIG. 6 is a bottom plan view of FIG. 3.
Figure 7:
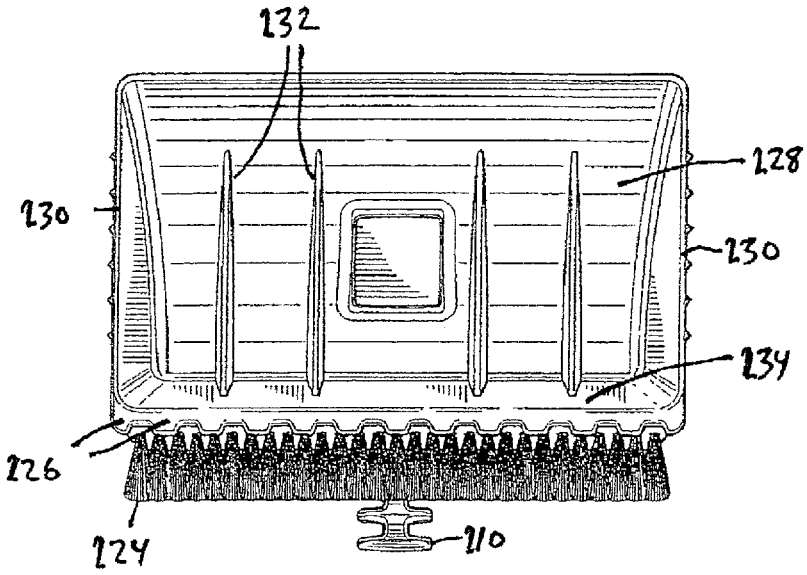
FIG. 7 is a front elevational view of FIG. 3.
Figure 8:
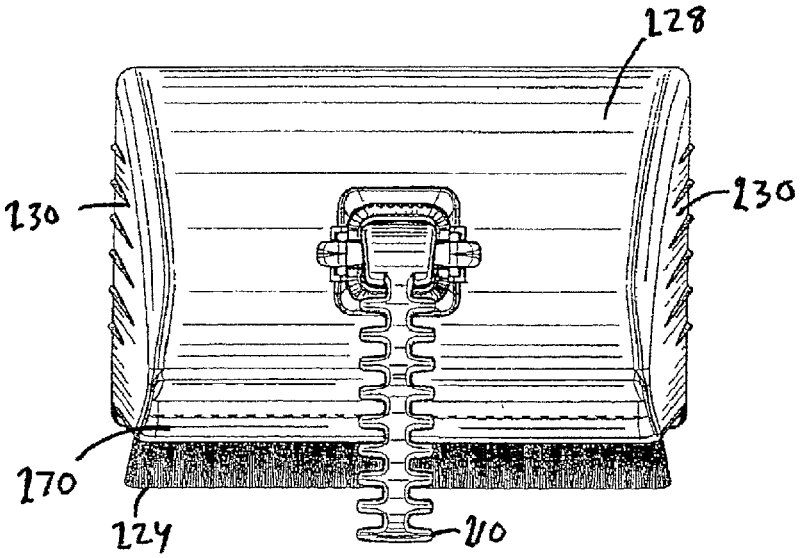
FIG. 8 is a rear elevational view of FIG. 3.
Figure 9:
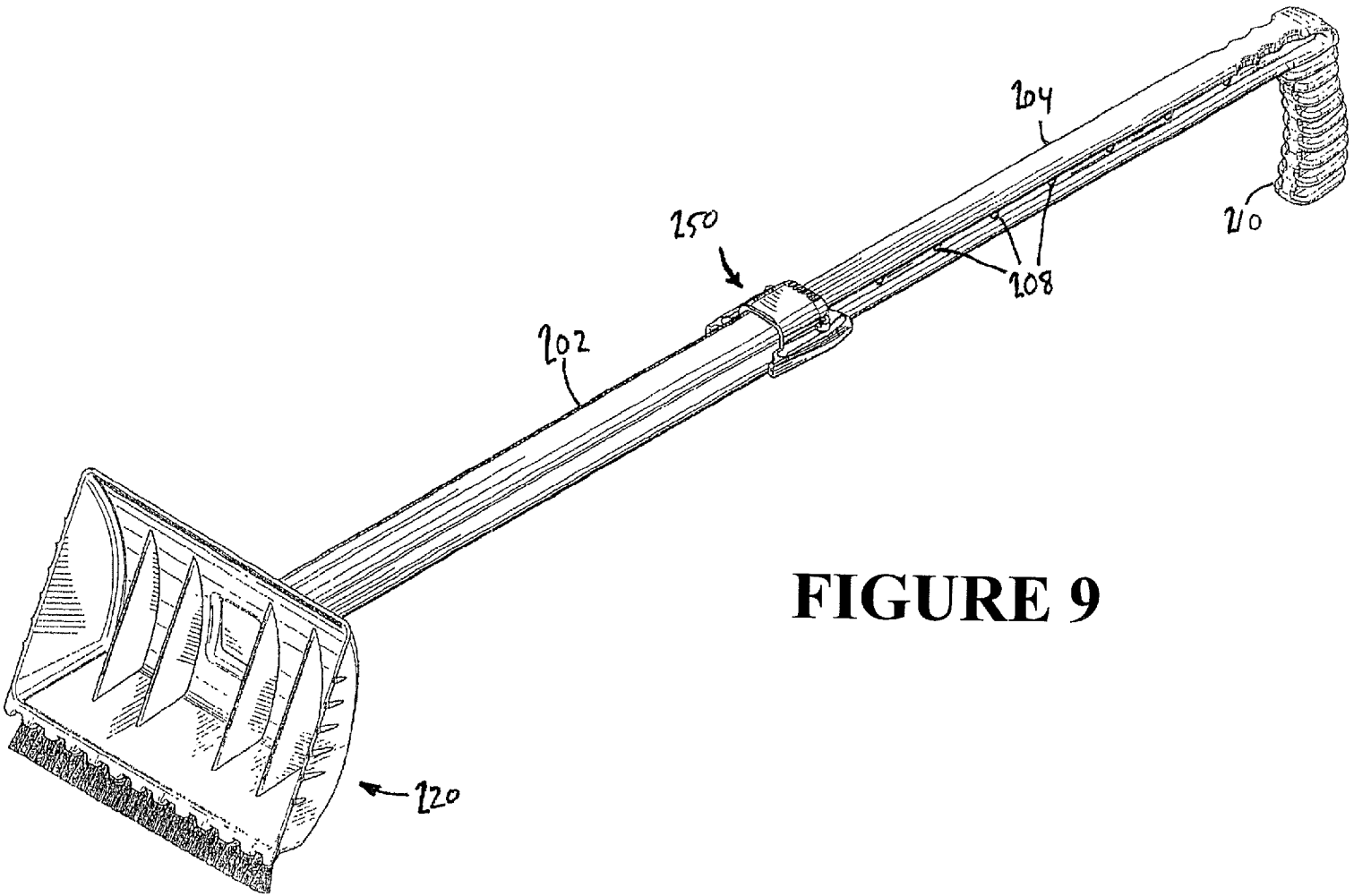
FIG. 9 is a top, front, left perspective view of FIG. 3, shown with its handle in another configuration.

A second exemplary embodiment of scraper tool 200 is shown in FIGS. 3-10, of which FIG. 3 is a top, front, left perspective view with the handle in a first configuration, FIG. 4 is a right side elevational view, FIG. 5 is a top plan view, FIG. 6 is a bottom plan view, FIG. 7 is a front elevational view, FIG. 8 is a rear elevational view, FIG. 9 is a top, front, left perspective view with the handle in a second configuration and FIG. 10 is a cross-section of the head. In this embodiment, scraper tool 200 includes a head 220 having one or more attack surfaces for removing a substance, such as bristles 224, squeegee member 225, and an elongated handle 201 attached at one end to head 220. In this embodiment, scraper tool 200 may be particularly useful for removing snow.

In accordance with the present invention, the head of scraper tool 200 is adapted to move material such as snow in a direction generally parallel to the handle of scraper tool 200 when the scraper tool 200 is translated in a direction generally parallel to the handle. To this end, the embodiment of FIGS. 3-10 includes a head 220 having a plow 222. Plow 222 extends generally to handle 201, i.e., plow 222 has a projection onto a plane that is perpendicular to handle 201 which defines an area that will be swept out as the scraper tool 200 is translated in a direction parallel to its handle. Plow 222 shown in FIGS. 3-10 includes a rear portion 228, a lower portion 234, and end portions 230 which stiffen plow 222 and inhibit snow from being pushed aside laterally as the tool is pushed forward.

Plow 222, when viewed from the side opposite handle 201, as in FIG. 3, has a portion which is generally concave. This concave portion of plow 222 engages snow when the scraper tool 200 is pushed, i.e., translated in a direction generally parallel to handle 201 with head 220 leading. This concave portion of plow 222 thus acts as a forward plow, i.e., a plow that functions when the scraper tool 200 is pushed in the forward direction.

Figure 11A:
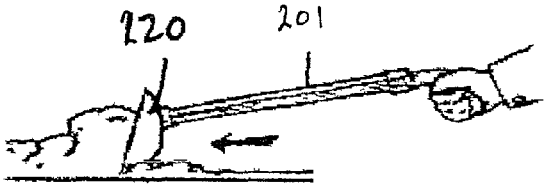
FIGS. 11(*a*)-11(*c*) illustrate the use of a scraper tool according to the present invention.
Figure 11B:
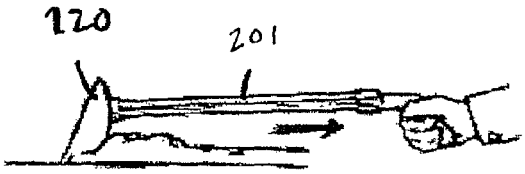
Figure 11C:
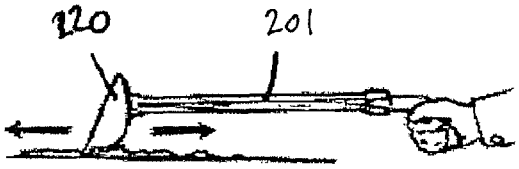

The scraper tool 200 of FIGS. 3-10 also includes a rearward-facing plow portion. Plow 222, when viewed from the side on which handle 201 is disposed, has a portion which is generally concave. The rearward-facing plow portion is most easily seen in the cross-sectional view of head 220 in FIG. 10, and is formed by lip 270, lower portion 234, and rear portion 228 of plow 222; portions 272 of sides 230 inhibit snow from being pushed aside laterally as the tool is pulled rearward. This concave portion of plow 222 engages snow when the scraper tool 200 is pulled, i.e., translated in a direction generally parallel to handle 201 with head 220 trailing. This concave portion of plow 222 thus acts as a rearward plow, i.e., a plow that functions when the scraper tool 200 is pulled in the rearward direction, as illustrated in FIG. 11(*b*).

Scraper tool 200 is adapted to remove snow from a surface both when the tool is both pushed by a user and when the tool is pulled by a user. Thus the scraper tool 200 may be employed using a sawing motion, as illustrated in FIG. 11(*c*), and snow will be cleared from a surface on both forward, pushing strokes and rearward, pulling strokes.

Figure 17:
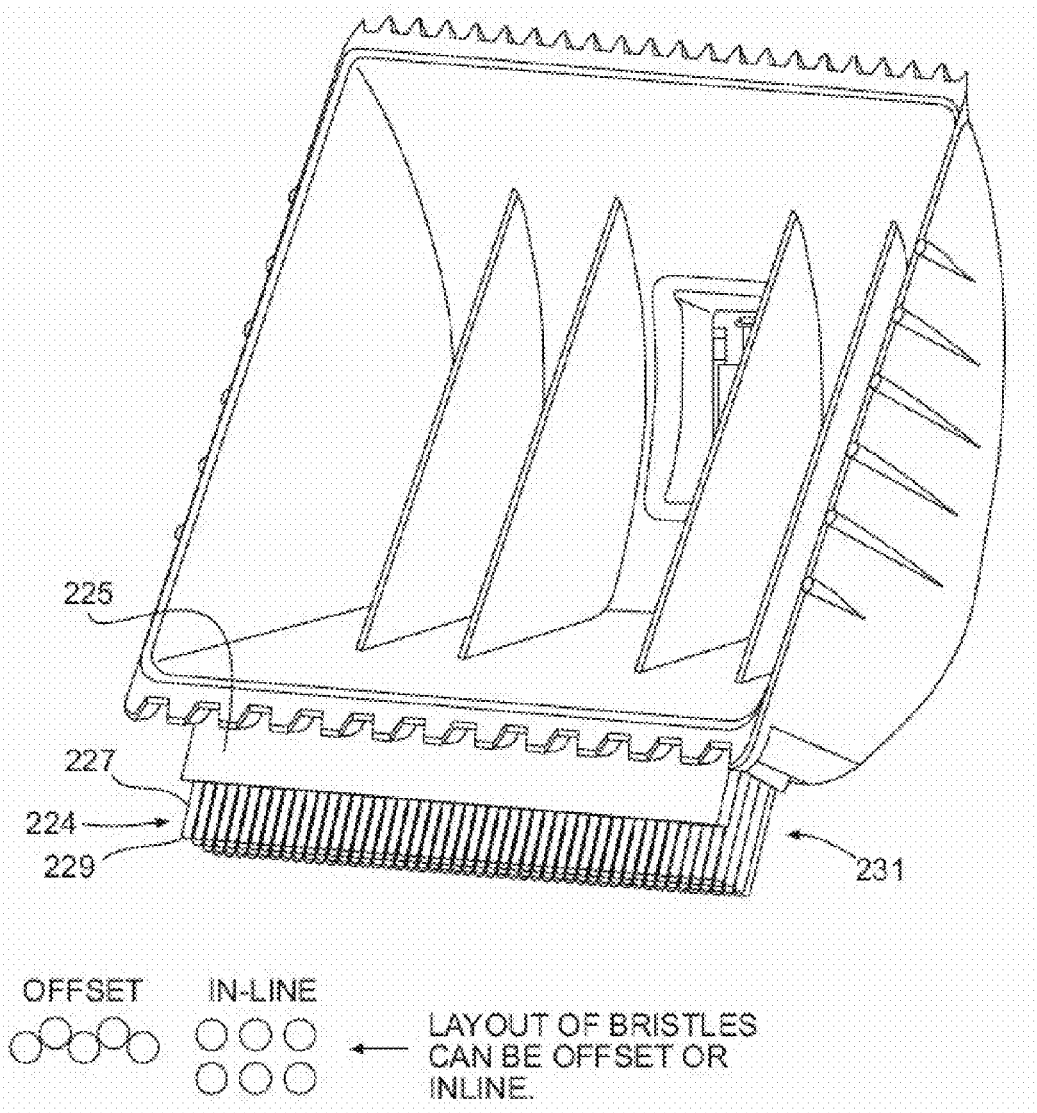
FIG. 17 is a perspective bottom view of FIG. 3, shown with a brush and squeegee elements mounted on the head.
Figure 18:
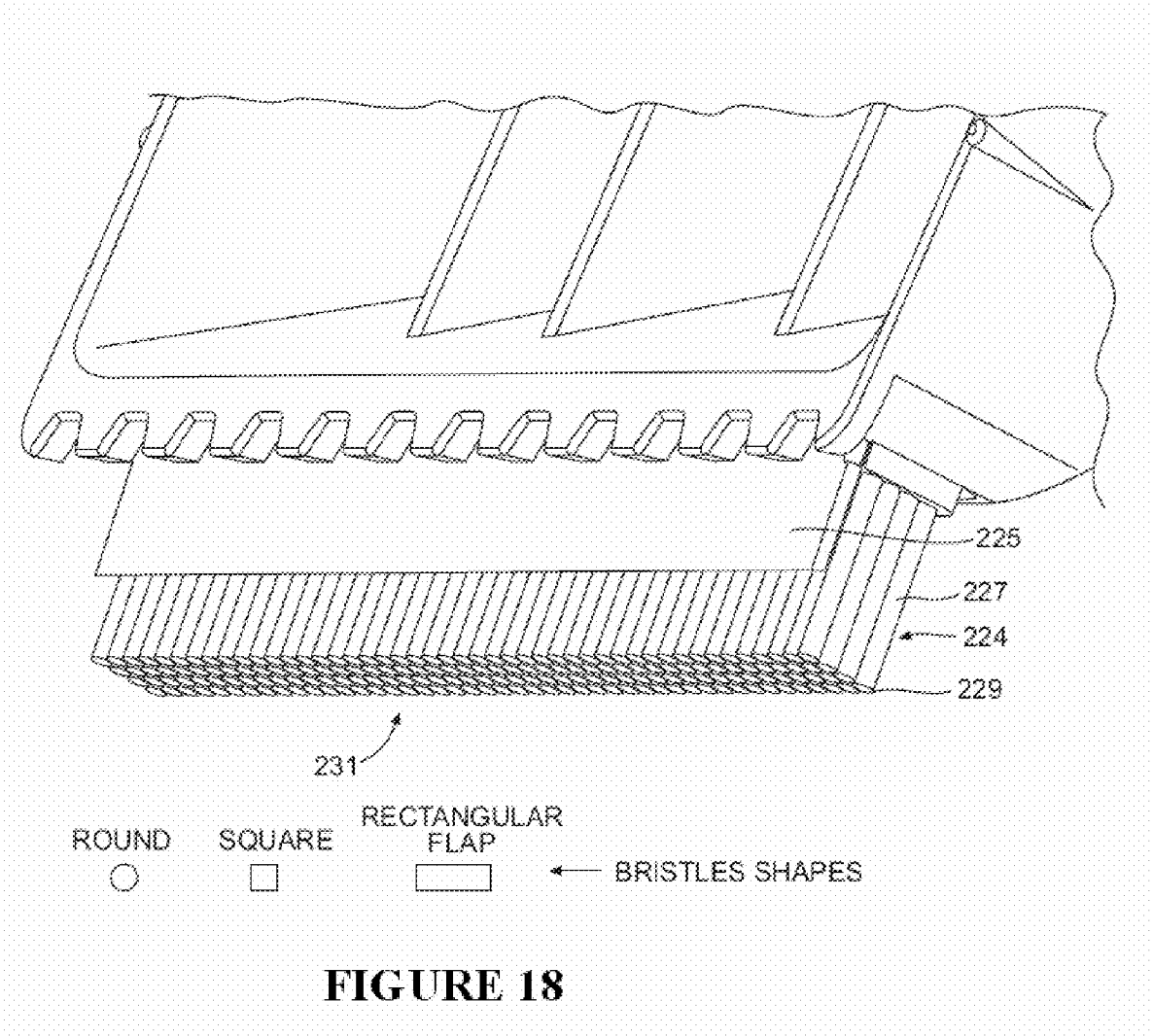
FIG. 18 is close-up perspective view of FIG. 17.

The edge of plow 222 may be provided with teeth 226 to aid in breaking an icy crust of snow to be removed. After the bulk of a snow covering is removed from a surface by plow 222, remaining snow may be removed by brushing the surface using bristles 224. Bristles 224 can help avoid the scraper tool 200 causing damage to the surface being cleared of snow, and can reduce friction during clearing of such snow. Additionally, scraper tool 200 may further include a squeegee member 225 positioned adjacent to bristles 224, both of which may be mounted to any surface of plow 222, preferably an edge thereof. As shown in FIGS. 17-18, bristles 224 have a shaft 227 and tip 229 and collectively form a brush 231. In an exemplary embodiment, brush 231, bristles 224 and squeegee member 225 may have the same structural configuration, mechanical properties and material properties as brush 13, bristles 71 and squeegee member 77 discussed in the exemplary embodiment of FIGS. 1-3. A head 220 that includes bristles 224 is preferred, but bristles 224 may be omitted if plow 222 is made of a material which will not damage a surface of being cleared of snow, and plow 222 is desirably constructed of such a material in any event. Bristles 224 are desirably relatively short compared to the height of 222; their purpose is primarily to remove a vestigal dusting of snow. Longer bristles tend to be flexible, and might bend as the tool is moved, assuming a bowed shape tending to push the head away from the surface to be cleared. Plow 222 is desirably made of molded plastic, for example, "rubberized" polypropylene. Ribs 232 provide additional stiffening for plow 222.

The handle of a scraper tool 200 in accordance with the present invention is desirably adjustable in length, so that it may be extended to provide a long reach when clearing snow, and may be collapsed for convenience in storing or transporting the tool. To this end, handle 201 of the embodiment shown in FIGS. 3-10 includes telescoping handle portions 202 and 204 and locking mechanism 250 to maintain handle portions 202 and 204 in a desired relative position. As can be seen FIG. 9, handle portion 204 includes holes 208. As can be seen in FIG. 5, locking mechanism 250, which is secured to handle portion 202, includes a pair of projections 258 which are urged toward handle portion 204 by spring members 256. Pressing the ends 252 of spring members 256 inwardly causes spring members 256 to pivot around pivot members 254, thereby causing projections 258 to be withdrawn from engagement with a hole 208. This permits handle portion 204 to slide freely with respect to handle portion 202 for adjustment to a desired length; releasing ends 252 permits projections 258 to engage another hole 208 to secure handle portions 202 and 204 to one another at the desired length.

Grip 210 extends generally perpendicular to handle 201, in the manner of a pistol grip, and facilitates application of force to the handle in a direction generally parallel to handle 201. Grip 210 and handle portion 204 may be made of a plastic material such as polyethylene and may be molded together as a single part. Grip 210 and extendable handle 201 enable snow to be cleared from difficult-to-reach surfaces such as the tops of sport-utility vehicles.

The shape of head 120 enables the scraper tool 200 to be used to clear snow from other areas, such as the ground under a vehicle body or around its tires.

It will be understood that other plow shapes, other handle structures, and other grip shapes may be employed in scraper tool 200 according to the present invention. FIGS. 12-16 illustrate other embodiments of scraper tool 200 according to the present invention.

FIG. 12 is a perspective view of another embodiment of a scraper tool 200 according to the present invention. The tool of FIG. 12 includes a head 1020 having a forward plow portion 1022 and a rearward plow portion 1070. Handle portion 1004, to which handle 1010 is secured, includes detents 1052 which engage ratchet mechanism 1056 in cover 1054 of handle portion 1002 to enable the handle length to be adjusted. Brush 1024 may be secured to plow 1022 by adhesive, snaps, staples, or the like.

The scraper tool 200 of FIG. 13 includes a twist-lock mechanism 1050 enabling telescoping tubes 1102 and 1004 to be loosened, adjusted to provide the desired handle length, and then tightened. Handle 1110 is secured to tube 1104, and plow 1120, which has brush 1124 secured to its lower edge, is secured to tube 1102.

The scraper tool 200 of FIG. 15 may include a ratchet mechanism similar to that shown in FIG. 12 to enable handle portions 1202 and 1204 to be adjusted. The tool includes both a vertical grip 1210 and horizontal grips 1212. Such grips help make a conveniently oriented grip available in a wide range of orientations of the tool. Head 1220 includes forward plow portion 1222, rearward plow portion 1270, and brush 1224.

FIGS. 15(*a*)-15(*b*) are perspective and side views, respectively, of another embodiment of a scraper tool 200 according to the present invention. A locking mechanism 1350 includes a spring-loaded pin that snaps into one of several available recesses to enable handle portions 1302 and 1304 to be locked at a selected handle length. A D-type handle 1310 is provided, and may be made rotatably adjustable. A brush 1324, having relatively long bristles, is secured to the rear of plow 1322 with a short length of its bristles extending below the lower edge of plow 1322.

The scraper tool 200 of FIG. 16 may include a spring-loaded pin mechanism similar to that shown in FIGS. 13(*a*)-13(*b*) to enable handle portions 1402 and 1404 to be adjusted. The tool includes a head having a plow 1420 that is generally planar and slightly biconcave in cross-section, and that is disposed generally perpendicular to the handle so as to remove material with both pushing and pulling strokes. A brush 1424 is secured to plow 1420.

Figure 19:
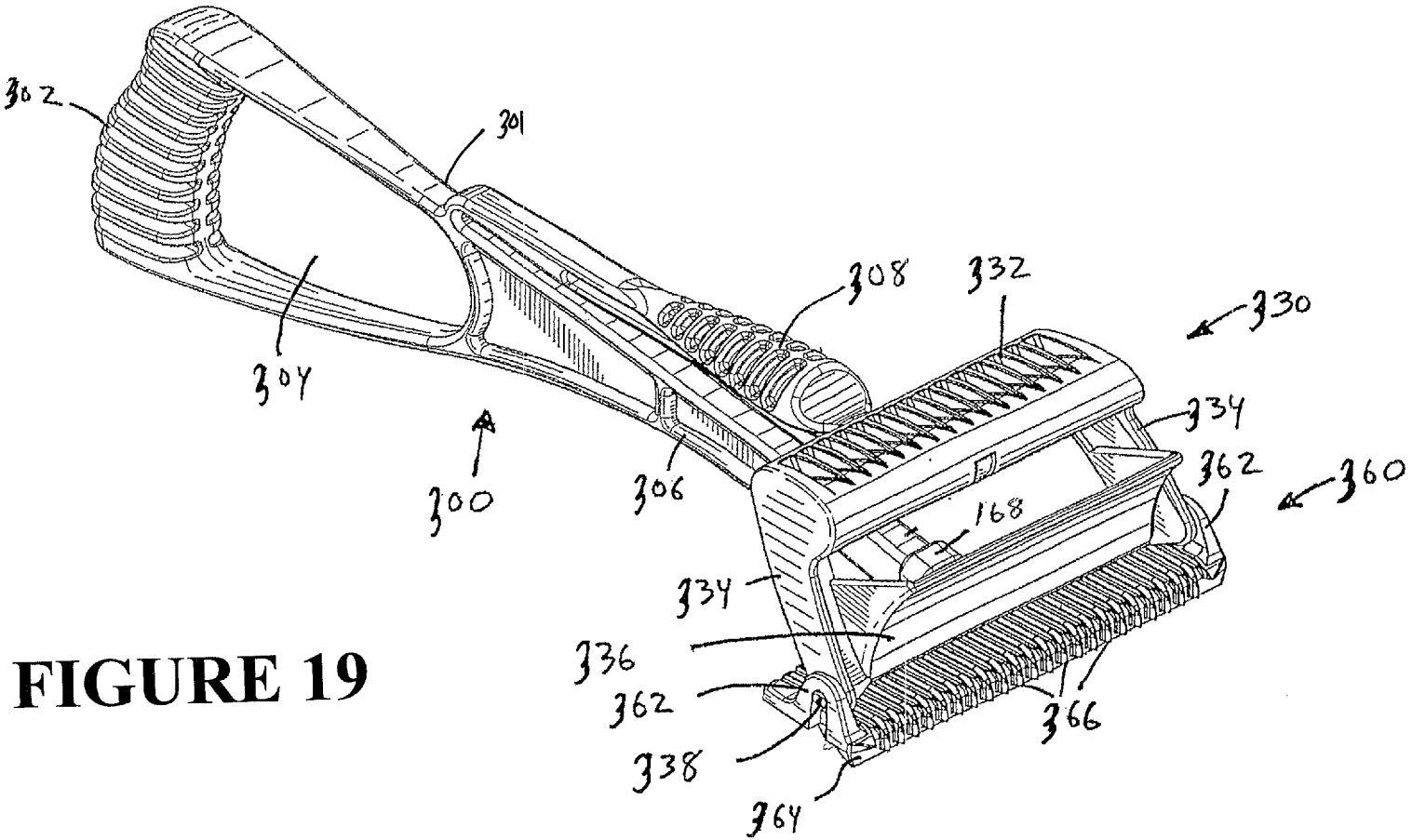
FIG. 19 is a top, front perspective view of an embodiment of a scraper tool according to the present invention.
Figure 20:
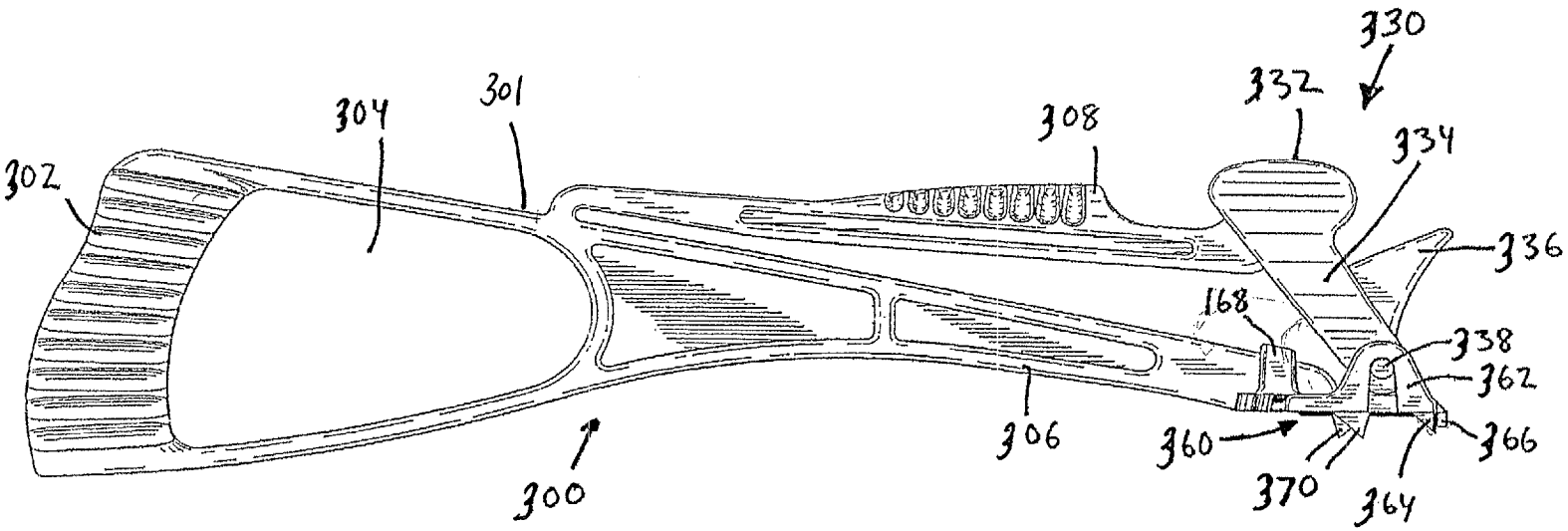
FIG. 20 is a side elevational view of the scraper tool of FIG. 19.
Figure 21:
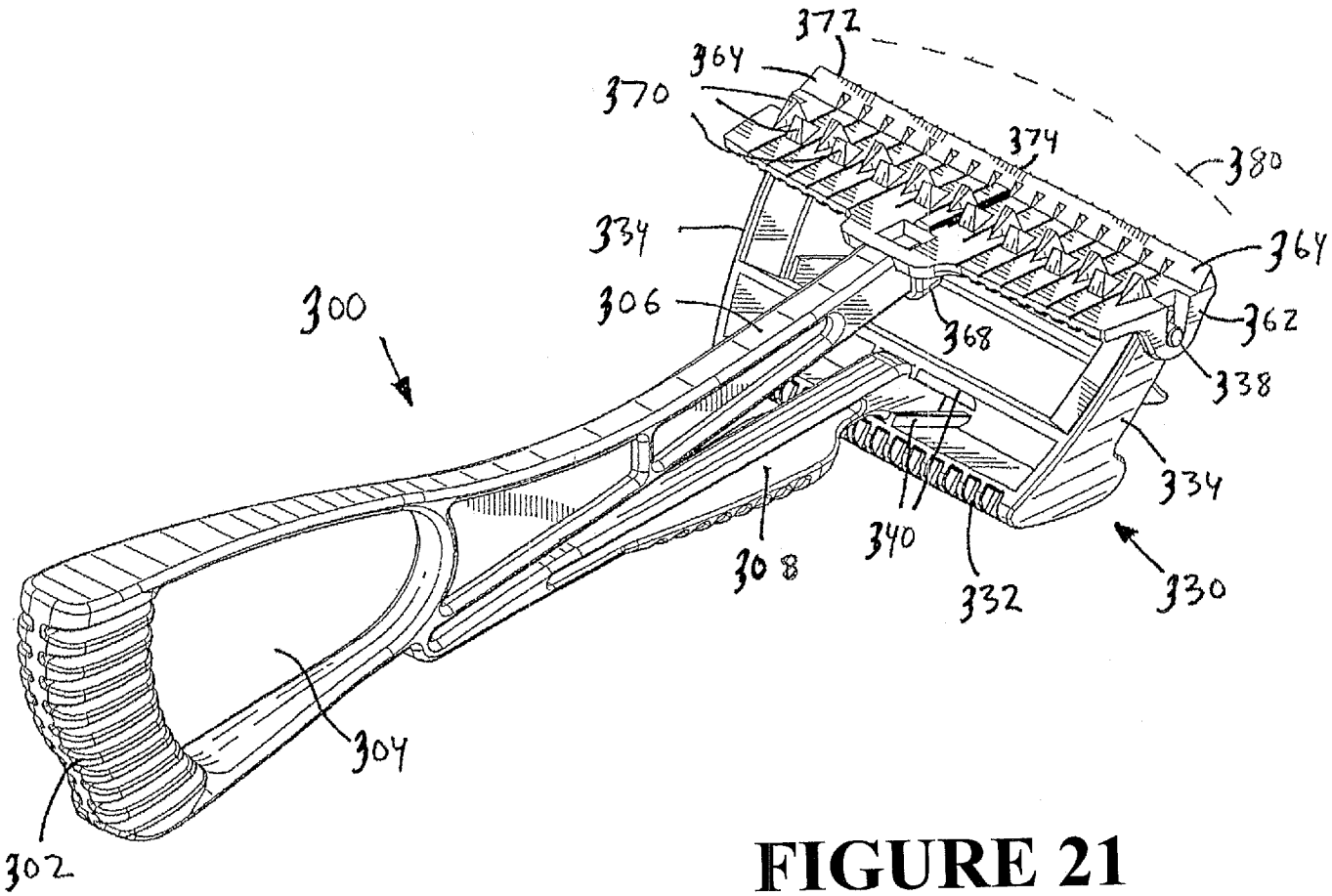
FIG. 21 is a top, rear perspective view of the scraper tool of FIG. 19
Figure 22:
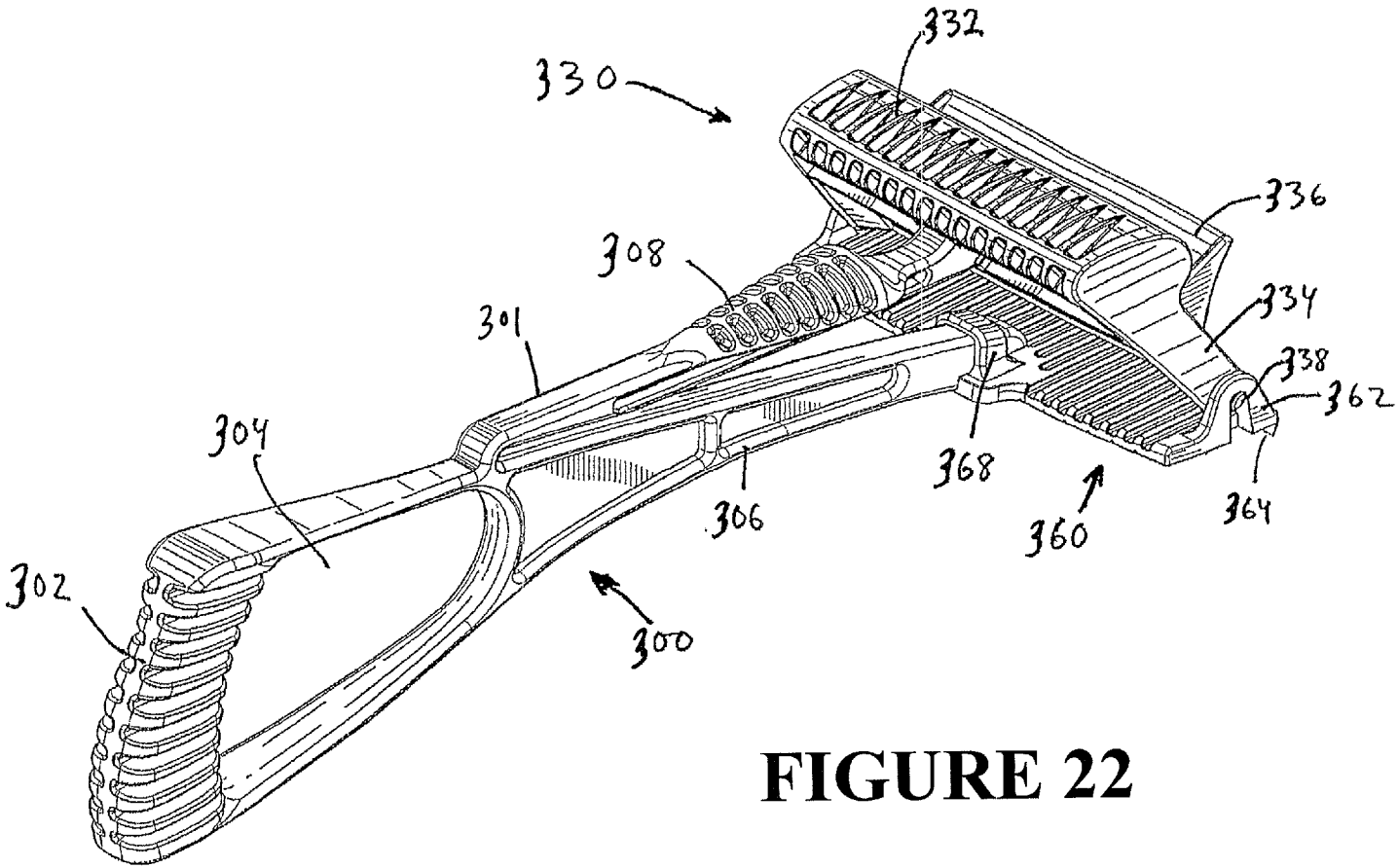
FIG. 22 is a bottom, rear perspective view of the scraper tool of FIG. 19.

A third exemplary embodiment of scraper tool 300 of the present invention is shown in FIGS. 19-22, of which FIG. 19 is a top, front perspective view, FIG. 20 is a side elevational view, FIG. 21 is a top, rear perspective view, and FIG. 22 is a bottom, rear perspective view. In this embodiment, scraper tool 300 includes a scraper component 360 having one or more attack surfaces, such as one or more blades 364, front teeth 366, bottom teeth 370, and a brush 390, and a handle component 301. Components 301 and 360 are preferably made of molded plastic.

Figure 28:
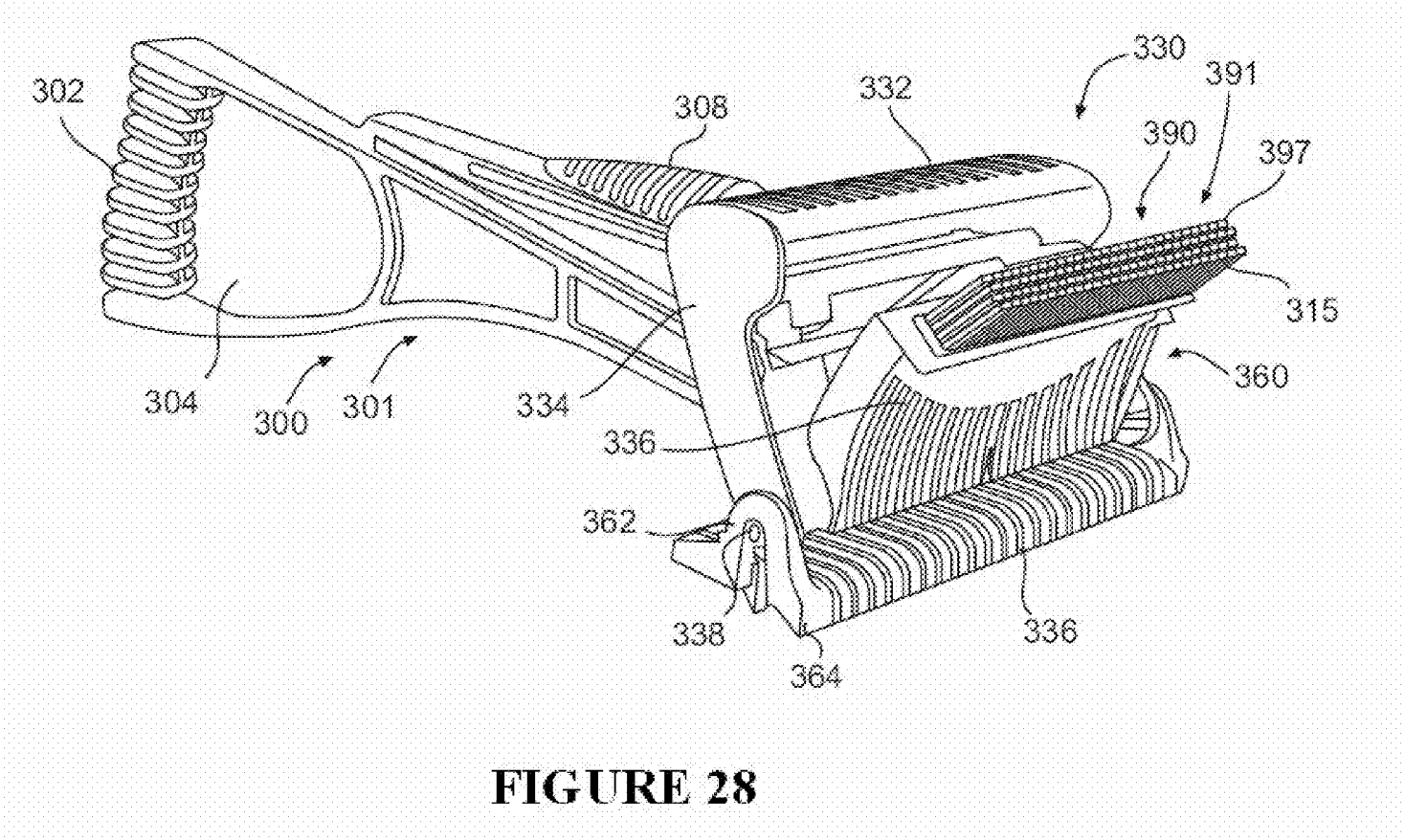
FIG. 28 is a elevated perspective view of an exemplary embodiment of the scraper tool including a brush.

Scraper component 360 includes four different structures for removing ice, frost, and/or snow from a surface: blade 364, front teeth 366, bottom teeth 370 and brush 390. Blade 364 has a scraping edge 372 and is a generally straight structure adapted to conform to a flat or moderately curved surface such as an automobile windshield and to wipe snow, sleet, or dislodged frost or ice from the surface in the manner of a squeegee. Front teeth 366, which are mounted just about the scraping surface of blade 364, terminate in points and aid in shearing of the ice by creating areas of high force concentration. Bottom teeth 370 have shapes similar to saw teeth and are mounted in a staggered fashion. Bottom teeth 370 can be used in a front and back motion to rip thick ice. Bottom teeth 370 can also be used in a hammer motion to crack through thick ice. Scraper component 360 is preferably made of polycarbonate, which is strong and also permits scraper component 360 to be somewhat deformable, although other materials can be used. The reasons why deformability is desirable will be discussed later. A brush 390 including a plurality of bristles 391 and/or a squeegee member 393 may be located adjacent to scraper component 360. In one embodiment, brush 390 and/or squeegee member 393 may be located behind bottom teeth 370 or along a surface of handle 301. Alternative as shown in FIG. 28, brush 390 may be positioned on an upper edge of deflector 336. Each bristle 391 of brush 390 may be constructed to have a shaft 395 and tip 397. In an exemplary embodiment, brush 390, bristles 391 and squeegee member 393 may have the same structural configuration, mechanical properties and material properties as brush 13, bristles 71 and squeegee member 77 discussed in the exemplary embodiment of FIGS. 1-3.

Handle component 301 includes a longitudinally-extending handle 306 and a strut 308. The front end of handle 306 is secured to scraper component 360 by being snapped into fastener 368 molded into scraper component 360. In the embodiment shown, the rear portion of handle 306 includes rear grip 302, the configuration of which is similar to a hand saw grip or a pistol grip. An aperture 304 in handle 306 enables a user's hand to surround and grasp rear grip 302. Although rear grip 302 is formed integrally with handle 306 in the embodiment shown, it might be made as a separate component in other embodiments. Handle component 301 is preferably made from polyethylene, although other materials can be used. A user may grasp rear grip 302 in order to apply force to the scraper component 360 in a direction that is generally along the length of handle 306 and generally to the right in the view shown in FIG. 20.

Front grip component 330 includes a front grip 332 and front grip supports 334. Pins 338 near the bottom of front grip supports 334 snap into openings in flanges 362 of scraper component 360 to secure front grip component 330 to scraper component 360. A user may grasp front grip 332 in order to apply force to the scraper component 360 in a direction that is generally perpendicular to the length of handle 306 and generally downward in the view shown in FIG. 20. Strut 308 is secured at one end to handle 306, and at its other end to scraper component 360 by being snapped into fastener 340 molded into front grip component 330. Strut 308 stabilizes front grip component 330 against rotation around pins 338 when force is applied to front grip 332. Strut 308 also may be used as a grip. Front grip component 330 also includes a deflector 336 which functions like a snowplow to help keep snow and ice debris moving away from a cleared area by prevent such debris from passing over the top of scraper component 360 as the scraper tool 300 is moved. Front grip component 330 is preferably made from polyethylene, although other materials can be used.

FIGS. 23(*a*)-23(*b*) show several ways of gripping the scraper tool 300 of FIGS. 19-22 embodiment. As shown in FIG. 23(*a*), one of a user's hands grasps rear grip 302 and applies a force $F_R$ directed generally along the length of handle 306 to move the scraper tool 300 across a surface to be cleared of ice, frost, and/or snow, and the user's other hand grasps front grip 332 and applies a force $F_F$ directed generally perpendicular to the length of handle 306 to urge scraper component 360 of the scraper tool 300 against the surface. This method allows the greatest force to be applied to scraper component 360; however, to clear some hard-to-reach spots it may not be possible to grasp and apply downward force to front grip 332. As shown in FIG. 23(*b*), in such situations, the user's hand may grasp strut 308 and apply a force $F_S$ directed generally perpendicular to the length of handle 306 to urge scraper component 360 of the scraper tool 300 against the surface.

The scraper tool 300 of FIGS. 19-22 includes surface texture on rear grip 302, front grip 332, and strut 308. In addition to being ornamental, such texture can aid in a user keeping a strong grasp of the scraper tool 300 during use.

FIGS. 24(*a*)-24(*c*) show several ways of using the scraper tool 300 of FIGS. 19-22. In FIG. 6(*a*), the scraper tool 300 is held at a relatively low angle, nearly parallel to the surface to be cleared, so that bottom teeth 370 contact a thick or tough layer of ice, and moved forward and back in a sawing motion. In FIG. 24(*b*), the scraper tool 300 is held at a steeper "angle of attack," so that front teeth 366 contact a brittle ice or crusty snow ice, and the surface is cleared by forward motion of the scraper tool 300. In FIG. 24(*c*), the scraper tool 300 is held at an intermediate "angle of attack," so that blade 364 contacts normal ice, frost, or snow, and the surface is cleared by forward motion of the scraper tool 300.

When scraping using a generally straight blade such as blade 364, it desirable for the blade to contact the surface to be cleared along its entire length. For instance, only a narrow swath is cleared on each stroke when a straight, rigid blade is used to scrape frost from a curved windshield. In order to avoid such problems, scraper component 360 is preferably somewhat flexible so that it can deform sufficiently under the forces applied to the scraper tool 300 to conform to the curvature of surfaces to be scraped.

In the scraper tool 300 of FIGS. 19-22, downward force is applied to scraper component 360 at its ends 10 by front grip supports 334 through pins 338. Therefore, scraper component 360 is preferably made with a slightly bowed shape. The direction of curvature desired for scraper component 360 is shown by line 380 in FIG. 22; the central area 374 of blade 364 is bowed in the upward direction in the view of FIG. 22. With such a curvature, when the scraper tool 300 is brought against a flat surface, the central area 374 of blade 364 will contact the surface first. As is clearly shown in FIG. 19 and elsewhere, scraper component 360 is supported in cantilevered fashion relative to front grip 332 by the front grip supports 334, which are respectively coupled to the flanges 362. Force applied to front grip 332 is coupled to scraper component 360 at its ends, bringing the ends of blade 364 into contact with the surface as scraper component 360 deforms, while central area 374 remains in contact with the surface. The same process occurs when the scraper tool 300 of FIGS. 19-22 is used on a convex surface such as an automobile windshield, except the deformation is greater. Flexing of ice scraper component 360 around a longitudinal axis is facilitated by the corrugated shape of the upper surface of scraper component 360 shown in FIGS. 19-21. Flexing of scraper component 360 also maintains front teeth 366 and bottom teeth 370 in contact with a surface to be cleared.

Figure 25:
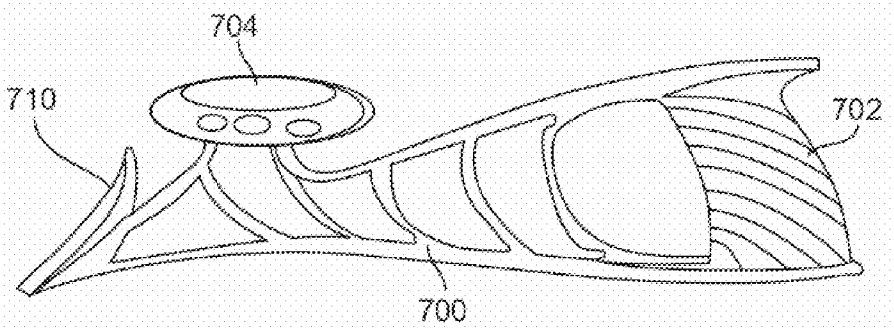
FIG. 25 is a side elevational view of a second embodiment of the scraper tool of FIG. 19.
Figure 26:
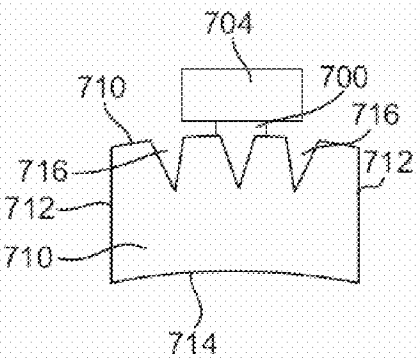
FIG. 26 is a front elevational view of the scraper tool of another embodiment.

FIG. 25 is a side elevational view and FIG. 26 is a front elevational view of another embodiment of an scraper tool 300 according to the present invention. The embodiment of FIGS. 25-26 includes handle 700 with a saw grip type rear grip 702 and a front grip 704 mounted directly to or fabricated as a part of handle 700. Handle 700 is mounted to the rear side of blade 710 midway between the lateral edges 712 thereof. The lower, scraping edge of blade 710 is curved in the opposite direction from that of front grip component 730. The upper portion of blade 710 functions as a deflector to help keep snow and ice debris moving away from the cleared area. When the scraper tool 300 of FIGS. 25-26 is brought against a flat surface, the ends of blade 710 will contact the surface first. Force applied to front grip 704 is coupled to scraper blade 710 in the middle, bringing it into contact with the surface as scraper blade 710 deforms, while the blade ends remain in contact with the surface. Flexing of blade 710 around a longitudinal axis is facilitated by the notches 716 in its upper edge.

Figure 27:
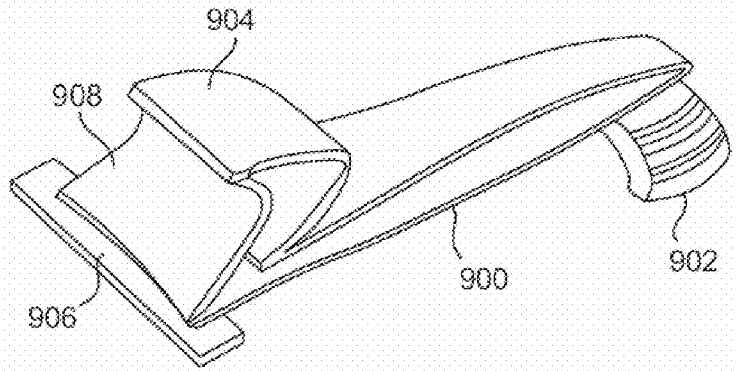
FIG. 27 is a top, front perspective view of an exemplary embodiment of the scraper tool according to the present invention.

FIG. 27 is a top, front perspective view of another embodiment of an scraper tool 300 according to the present invention. In the scraper tool 300 of FIG. 27, a handle 900, rear grip 902, front grip 904, and deflector 908 may be molded as a single piece. Scraper 906, which may be like scraper component 760 of FIGS. 19-22, is secured adjacent the front of handle 900.

The scraper tool 300 of the present invention is suited to a person's normal positions and motions. Ergonomic features of the design, including a front grip and a saw-style rear grip, aid in the generation of scraping force from a person's natural positions and movements.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A hand held scraper for abrading a surface or removing a substance from a surface, wherein the scraper comprises:

a body;

a handle attached to said body;

a first set of flexible cantilevered abraders capable of independently moving relative to one another, each flexible cantilevered abrader of the first set of flexible cantilevered abraders extending from the body in a first direction, wherein at least one cantilevered abrader of said first set comprise:

a first end hinged to a surface of said body;

a first groove defined in an upper surface of said cantilevered abrader for increasing the flexibility of said cantilevered abrader, wherein said first groove extends in a second direction along a width of said cantilever abrader and is positioned adjacent to and between said first end and an opposed second end; and a scraping edge disposed at a lower surface of the second end; and two substantially rigid members that extend from the body in the first direction and constrain a vertical range of motion of said first set of cantilevered abraders, wherein said first set of cantilever abraders are positioned adjacent to and between said two substantially rigid members.

2. The hand held scraper of claim 1, further comprising a second set of flexible cantilever abraders spaced apart from and facing an opposite direction of said first set of flexible cantilever abraders.

3. The hand held scraper of claim 1, further comprising a shield for deflecting substances, wherein said shield is positioned above said first set of cantilever abraders and wherein a lower edge of said shield further constrains said vertical range of motion of said cantilever abraders.

4. The hand held scraper of claim 3, further comprising a tapered notch positioned on an edge of said shield adapted for cleaning a windshield wiper blade.

5. The hand held scraper of claim 1, wherein said cantilever abrader further comprises a second groove defined in a lower surface of said cantilevered abrader and wherein said second groove extends along a width of said cantilever abrader and is positioned adjacent to said first end.

6. The hand held scraper of claim 1, further comprising a plurality of teeth positioned on a lower surface of said body capable of breaking-up hard substances.

7. The hand held scraper of claim 1, further comprising a scraper blade attached to said body and positioned adjacent to a respective one of said substantially rigid members.

8. The hand held scraper of claim 1, further comprising a liquid dispenser capable of dispensing a cleaning fluid, wherein said liquid dispenser is positioned within a cavity of said handle.

9. The hand held scraper of claim 1, further comprising a brush mounted to said body, wherein said brush comprises a plurality of bristles that are independently moveable relative to one another and wherein said bristles form a substantially water impermeable barrier.

10. A hand held scraper for abrading a surface or removing a substance from a surface, wherein the scraper comprises:

a body;

a handle attached to said body; and a plurality of flexible cantilevered abraders capable of independently moving relative to one another, each flexible cantilevered abrader of the plurality of flexible cantilevered abraders extending from the body in a first direction, wherein at least one cantilever abrader of said plurality of cantilevered abraders comprises:

a first end hinged to a surface of said body;

a first groove defined in an upper surface of said cantilevered abrader for increasing the flexibility of said cantilevered abrader;

a second groove defined in an lower surface of said cantilevered abrader for increasing the flexibility of said cantilevered abrader, wherein said first and second grooves extend in a second direction along a width of said cantilever abrader and are positioned adjacent to and between said first end and an opposed second end; and a scraping edge disposed at a lower surface of the second end, wherein the thickness of said cantilever abrader between said first and second grooves is about 0.5 cm to about 1.5 cm to enable flexible vertically displacement of said cantilever abrader.

11. The hand held scraper of claim 10, wherein said upper surface comprises two or more sections angularly oriented with respect to one another.

12. The hand held scraper of claim 10, wherein said upper surface comprises three or more sections angularly oriented with respect to one another.

13. The hand held scraper of claim 10, wherein said cantilever abrader comprises an abrasive protrusion positioned on a section of said upper surface of said cantilever abrader, wherein said section is substantially perpendicular to said scraping edge.

14. The hand held scraper of claim 10, further comprising two substantially rigid members that constrain a vertical range of motion of said cantilever abraders, wherein said plurality of cantilever abraders are positioned adjacent to and between said two substantially rigid members.

15. The hand held scraper of claim 10, wherein said body is configured as a two tiered structure comprising an upper frame and a lower frame attached to said upper frame, wherein said handle is attached to said upper frame and wherein said first end is hinged to a surface of said lower frame.

16. The hand held scraper of claim 15, further comprising a brush mounted to said upper frame, wherein said brush comprises a plurality of bristles that are independently moveable relative to one another.

17. The hand held scraper of claim 16, wherein said handle has a domed shape configuration attached to an inclined elongated wrist rest flange.

18. The hand held scraper of claim 16, further comprising a third frame removably attached to said lower frame, and wherein a plurality of teeth are positioned on a lower surface of said third frame.

19. The hand held scraper of claim 10, further comprising a shield for deflecting said substance, wherein said shield is positioned above said plurality of cantilever abraders and wherein a lower edge of said shield further constrains said vertical range of motion of said cantilever abraders.

20. The hand held scraper of claim 10, comprising a liquid dispenser capable of dispensing a cleaning fluid, wherein said liquid dispenser is positioned within a cavity of said handle.

* * * * *

UNITED STATES PATENT AND TRADEMARK OFFICE

CERTIFICATE OF CORRECTION

PATENT NO. : 8,438,688 B2
APPLICATION NO. : 12/692436
DATED : May 14, 2013
INVENTOR(S) : Marvin Weinberger and Tucker J. Marion It is certified that error appears in the above-identified patent and that said Letters Patent is hereby corrected as shown below:

In the Claims:

Column 24, line 38, delete “shape” and insert therefor --shaped--

Column 24, line 49, insert --further-- before the word “comprising”

Signed and Sealed this
Sixteenth Day of July, 2013

Teresa Stanek Rea
*Acting Director of the United States Patent and Trademark Office*